US009777494B2

(12) United States Patent
Lochtefeld et al.

(10) Patent No.: US 9,777,494 B2
(45) Date of Patent: Oct. 3, 2017

(54) METHOD AND APPARATUS FOR PRODUCING PROGRESSIVE WAVES SUITABLE FOR SURFING USING STAGGERED WAVE GENERATORS IN SEQUENCE

(75) Inventors: Thomas J. Lochtefeld, LaJolla, CA (US); Dirk Bastenhof, Ede (NL)

(73) Assignee: Stagger Reef Pte. Ltd., Singapore (SG)

( * ) Notice: Subject to any disclaimer, the term of this patent is extended or adjusted under 35 U.S.C. 154(b) by 378 days.

(21) Appl. No.: 14/115,415

(22) PCT Filed: May 4, 2011

(86) PCT No.: PCT/SG2011/000176

§ 371 (c)(1),
(2), (4) Date: Mar. 18, 2014

(87) PCT Pub. No.: WO2012/150908

PCT Pub. Date: Nov. 8, 2012

(65) Prior Publication Data

US 2014/0189948 A1 Jul. 10, 2014

(51) Int. Cl.
*E04H 4/00* (2006.01)

(52) U.S. Cl.
CPC ..... *E04H 4/0006* (2013.01)

(58) Field of Classification Search
CPC . E04H 4/0006; A63B 69/0093; A63B 69/125; F04D 35/00
USPC ..... 405/79, 80
See application file for complete search history.

(56) References Cited

U.S. PATENT DOCUMENTS 3,350,724 A * 11/1967 Leigh ..... E04H 4/0006 4/491
3,913,332 A 10/1975 Forsman
4,062,192 A 12/1977 Biewer
4,999,860 A 3/1991 Chutter et al.
5,342,145 A * 8/1994 Cohen ..... E04H 4/0006 4/491
5,833,393 A 11/1998 Carnahan et al.
6,738,992 B2 * 5/2004 Lochtefeld ..... E04H 4/0006 4/491

(Continued)

*Primary Examiner* — Janie Loeppke
(74) *Attorney, Agent, or Firm* — J. John Shimazaki

(57) ABSTRACT

The disclosure relates to a method and apparatus for a wave pool having a deep end and a shallow end, wherein a plurality of wave generators is provided for producing wave segments in the wave pool. The wave generators are preferably extended substantially along the deep end in a substantially staggered manner relative to the travel direction of the wave segments. A pair of dividing walls is preferably provided in front of each wave generator, wherein the dividing walls are extended substantially forward in the travel direction and substantially parallel to each other or with a fade angle of no more than about 20 to 30 degrees relative to each other. The wave generators are preferably operated in sequence from one side of the pool to the other, such that a plurality of wave segments is generated at pre-selected time intervals, and such that the plurality of wave segments can travel forward and then, due to the stagger of the wave generators, merge together to form a substantially uniform resultant periodic wave. The resultant wave forms and travels forward and then breaks along the shallow end which preferably comprises a break line.

21 Claims, 13 Drawing Sheets

(56) References Cited

U.S. PATENT DOCUMENTS

| | | | |
|---|---|---|---|
| 6,920,651 | B2 | 7/2005 | Roberts |
| 6,964,069 | B2 | 11/2005 | English et al. |
| 7,144,197 | B2 | 12/2006 | Black |

* cited by examiner

FIGURE 13a

Initial Wave Height of 1.0 m

| Fade Angle | α | L1 | L2 | L3 | D | F | H1 | H2 | H3 | ΔH2-H3 | ΔH2-H3 % | Wave Speed (forward celerity) | Spread Speed (on each side) | Convergence Speed (laterally) |
|---|---|---|---|---|---|---|---|---|---|---|---|---|---|---|
| 0 | 0 | 4.0m | 4.0 m | 4.0 m | 4.0 m | 2.0 m | 1.0 m | 1.0 m | 1.0 m | 0 | 0% | ≈5.42 mps | 0 | 0 |
| 5 | 0.0872 | 4.0m | 4.35 m | ≈4.81 m | 4.0 m | 2.0 m | 1.0 m | 0.96 m | 0.91 m | 0.05 m | 5.2% | ≈5.42 mps | ≈0.24 mps | ≈0.48 mps |
| 10 | 0.1745 | 4.0m | 4.69 m | ≈5.62 m | 4.0 m | 2.0 m | 1.0 m | 0.92 m | 0.84 m | 0.08 m | 8.6% | ≈5.42 mps | ≈0.46 mps | ≈0.92 mps |
| 15 | 0.2617 | 4.0m | 5.04 m | ≈6.42 m | 4.0 m | 2.0 m | 1.0 m | 0.89 m | 0.79 m | 0.10 m | 11.6% | ≈5.42 mps | ≈0.70 mps | ≈1.40 mps |
| 20 | 0.3491 | 4.0m | 5.4 m | ≈7.22 m | 4.0 m | 2.0 m | 1.0 m | 0.86 m | 0.74 m | 0.12 m | 13.4% | ≈5.42 mps | ≈0.90 mps | ≈1.80 mps |
| 30 | 0.5236 | 4.0m | 6.1 m | ≈8.87 m | 4.0 m | 2.0 m | 1.0 m | 0.81 m | 0.67 m | 0.14 m | 17.3% | ≈5.42 mps | ≈1.4 mps | ≈2.8 mps |

Fade Angle = the angle between the two dividing walls
α = fade angle in radians
L1 = width of caisson which is also the initial width (or lateral length) of the wave segment
L2 = width (or lateral length) of wave segment at convergence
L3 = projected width (or lateral length) of adjacent wave segment at convergence – without accounting for merge
D = wall extension, i.e., forward distance from front wall of caisson to initial convergence point
F = depth of pool floor at creation of wave segment
H1 = wave height at wave creation (in front of caisson)
H2 = wave height of wave segment at convergence
H3 = wave height of adjacent wave segment at convergence
ΔH2-H3 = the wave height differential between H2 and H3 at convergence
ΔH2-H3 % = the wave height differential between H2 and H3 at convergence as a percentage
Wave Speed = the approx. forward velocity of the wave segment
Spread Speed = the approx. rate at which each wave segment widens or elongates laterally on each side due to fade angle
Convergence Speed = the approx. combined net speed at which adjacent wave segments converge laterally
Note: The stagger angle is assumed to be 45 degrees when the fade angle is 10 degrees, but varies otherwise, wherein the distance from the caisson to the distal end of the long dividing wall is assumed to be constant, i.e., 9.3 m FIGURE 13b Initial Wave Height of 2.0 m

| Fade Angle | α | L1 | L2 | L3 | D | F | H1 | H2 | H3 | ΔH2-H3 | ΔH2-H3 % | Wave Speed (forward celerity) | Spread Speed (on each side) | Convergence Speed (laterally) |
|---|---|---|---|---|---|---|---|---|---|---|---|---|---|---|
| 0 | 0 | 4.0m | 4.0 m | 4.0 m | 4.0 m | 4.0 m | 2.0 m | 2.0 m | 2.0 m | 0 | 0% | ≈7.67 mps | 0 | 0 |
| 5 | 0.0872 | 4.0m | 4.35 m | ≈4.81 m | 4.0 m | 4.0 m | 2.0 m | 1.91 m | 1.82 m | 0.09 m | 5.2% | ≈7.67 mps | ≈0.34 mps | ≈0.68 mps |
| 10 | 0.1745 | 4.0m | 4.69 m | ≈5.62 m | 4.0 m | 4.0 m | 2.0 m | 1.85 m | 1.69 m | 0.16 m | 8.6% | ≈7.67 mps | ≈0.67 mps | ≈1.35 mps |
| 15 | 0.2617 | 4.0m | 5.04 m | ≈6.42 m | 4.0 m | 4.0 m | 2.0 m | 1.78 m | 1.58 m | 0.20 m | 11.6% | ≈7.67 mps | ≈1.00 mps | ≈2.00 mps |
| 20 | 0.3491 | 4.0m | 5.4 m | ≈7.22 m | 4.0 m | 4.0 m | 2.0 m | 1.72 m | 1.49 m | 0.23 m | 13.4% | ≈7.67 mps | ≈1.33 mps | ≈2.67 mps |
| 30 | 0.5236 | 4.0m | 6.1 m | ≈8.87 m | 4.0 m | 4.0 m | 2.0 m | 1.62 m | 1.34 m | 0.28 m | 17.3% | ≈7.67 mps | ≈2.02 mps | ≈4.04 mps |

Fade Angle = the angle between the two dividing walls
α = fade angle in radians
L1 = width of caisson which is also the initial width (or lateral length) of the wave segment
L2 = width (or lateral length) of wave segment at convergence
L3 = projected width (or lateral length) of adjacent wave segment at convergence – without accounting for merge
D = wall extension, i.e., forward distance from front wall of caisson to initial convergence point
F = depth of pool floor at creation of wave segment
H1 = wave height at wave creation (in front of caisson)
H2 = wave height of wave segment at convergence
H3 = wave height of adjacent wave segment at convergence
ΔH2-H3 = the wave height differential between H2 and H3 at convergence
ΔH2-H3 % = the wave height differential between H2 and H3 at convergence as a percentage
Wave Speed = the approx. forward velocity of the wave segment
Spread Speed = the approx. rate at which each wave segment widens or elongates laterally on each side due to fade angle
Convergence Speed = the approx. combined net speed at which adjacent wave segments converge laterally
Note: The stagger angle is assumed to be 45 degrees when the fade angle is 10 degrees, but varies otherwise, wherein the distance from the caisson to the distal end of the long dividing wall is assumed to be constant, i.e., 9.3 m FIGURE 13c Initial Wave Height of 3.0 m

| Fade Angle | α | L1 | L2 | L3 | D | F | H1 | H2 | H3 | ΔH2-H3 | ΔH2-H3 % | Wave Speed (forward celerity) | Spread Speed (on each side) | Convergence Speed (laterally) |
|---|---|---|---|---|---|---|---|---|---|---|---|---|---|---|
| 0 | 0 | 4.0m | 4.0 m | 4.0 m | 4.0 m | 6.0 m | 3.0 m | 3.0 m | 3.0 m | 0 | 0% | ≈9.40 mps | 0 | 0 |
| 5 | 0.0872 | 4.0m | 4.35 m | ≈4.81 m | 4.0 m | 6.0 m | 3.0 m | 2.88 m | 2.73 m | 0.15 m | 5.2% | ≈9.40 mps | ≈0.41 mps | ≈0.82 mps |
| 10 | 0.1745 | 4.0m | 4.69 m | ≈5.62 m | 4.0 m | 6.0 m | 3.0 m | 2.77 m | 2.53 m | 0.24 m | 8.6% | ≈9.40 mps | ≈0.82 mps | ≈1.64 mps |
| 15 | 0.2617 | 4.0m | 5.04 m | ≈6.42 m | 4.0 m | 6.0 m | 3.0 m | 2.67 m | 2.37 m | 0.30 m | 11.6% | ≈9.40 mps | ≈1.22 mps | ≈2.44 mps |
| 20 | 0.3491 | 4.0m | 5.4 m | ≈7.22 m | 4.0 m | 6.0 m | 3.0 m | 2.58 m | 2.23 m | 0.35 m | 13.6% | ≈9.40 mps | ≈1.65 mps | ≈3.29 mps |
| 30 | 0.5236 | 4.0m | 6.1 m | ≈8.87 m | 4.0 m | 6.0 m | 3.0 m | 2.43 m | 2.01 m | 0.42 m | 17.3% | ≈9.40 mps | ≈2.47 mps | ≈4.94 mps |

Fade Angle = the angle between the two dividing walls
α = fade angle in radians
L1 = width of caisson which is also the initial width (or lateral length) of the wave segment
L2 = width (or lateral length) of wave segment at convergence
L3 = projected width (or lateral length) of adjacent wave segment at convergence – without accounting for merge
D = wall extension, i.e., forward distance from front wall of caisson to initial convergence point
F = depth of pool floor at creation of wave segment
H1 = wave height at wave creation (in front of caisson)
H2 = wave height of wave segment at convergence
H3 = wave height of adjacent wave segment at convergence
ΔH2-H3 = the wave height differential between H2 and H3 at convergence
ΔH2-H3 % = the wave height differential between H2 and H3 at convergence as a percentage
Wave Speed = the approx. forward velocity of the wave segment
Spread Speed = the approx. rate at which each wave segment widens or elongates laterally on each side due to fade angle
Convergence Speed = the approx. combined net speed at which adjacent wave segments converge laterally
Note: The stagger angle is assumed to be 45 degrees when the fade angle is 10 degrees, but varies otherwise, wherein the distance from the caisson to the distal end of the long dividing wall is assumed to be constant, i.e., 9.3 m

METHOD AND APPARATUS FOR PRODUCING PROGRESSIVE WAVES SUITABLE FOR SURFING USING STAGGERED WAVE GENERATORS IN SEQUENCE

RELATED APPLICATIONS

This application claims the benefit of the filing date of International Application No. PCT/SG2011/000176, filed May 4, 2011.

FIELD OF THE INVENTION

The present invention relates to the field of wave pools, and in particular, to a wave pool that comprises using multiple staggered wave generators in sequence with dividing wall extensions for enhanced performance that enable wave segments to be formed and merged together to form a single progressive wave that breaks along an obliquely angled sloped shoreline.

BACKGROUND OF THE INVENTION

The art of surfing requires a combination of natural ability, practice and skill. It requires making continual adjustments to the surfer's balance, to keep a large longitudinally oriented surfboard skimming across the surface of the water traveling forward at just the right velocity and angle, such that the wave can propel the board and surfer forward, while at the same time, the surfer is able to lean and make adjustments to carve out a path at just the right moment, and with just the right directional feet pressure and body English. It is essentially a careful balancing act that is required to keep the board and rider in a constantly changing equilibrium state that requires a constant awareness of the body's position relative to the board, and the board's position relative to the water, wherein the board and surfer are synchronized together, in various controlled directions, while at the same time, creating maneuvers of interest by using the forces of gravity and the sloped surface of the moving wave.

Because of the need to synchronize these movements and constantly make adjustments, it is also important that the wave that the board is riding on is of sufficient size, shape and quality to enable the surfer to generate speed, and be provided with ramps, transitions, sections, and hollow tubes which allow the surfer to perform tricks and maneuvers while keeping his or her balance. For one thing, the surface structure that the board travels on, and cuts across, and maneuvers relative to, must be sufficiently smooth and free of turbulence and surface discontinuities to enable the board to successfully skim across and cut through the wave, and allow the surfer to perform the desired maneuvers and tricks. If there are any irregularities in the structure of the wave, such as ridges, angles, ripples, vortices, chops, etc., the wave will be more difficult to maneuver and stay balanced on. For example, based on the size of a standard surf board, including its overall width, length and thickness, it is critical that the smooth portion of the wave be sufficiently large enough, and wide enough, such that the board can be fully supported by the wave structure, wherein, as the board skims and maneuvers across the wave surface, the surfer can make the necessary adjustments and shifts that will enable him or her to maintain balance on the board. If there is too much turbulence on the surface, for example, or if the smooth portion of the wave is not large or wide enough, the board can lose its planing ability or be diverted, which may cause the surfer to either lose the wave completely, or have to make quick compensating adjustments and corrections, which can increase the chances that he or she will wipe-out by making an erroneous change in body position.

Due to the size of a standard surfboard, which is typically about 18 to 21 inches (40 cm to 55 cm) wide, and about 2 to 3 inches (5 cm-7 cm) thick, and about 70 to 120 inches (2 to 3 meters) long, as well as the shape of the board, which can have a taper or curve to facilitate carving, it is desirable for the smooth portion of the wave to be large enough to fully support the board, as well as its varied movements, which enables the surfer to maneuver on the waves properly. For example, if there are large ripples, bumps or chops that are formed on a wave that are spaced apart every 12 to 24 inches (30 to 60 cm) or so, then, as the board encounters those bumps, etc., the surfer will have to take a very conservative (minimal maneuver) surfing stance with knees bent, which act as shock absorbers, and use very small quick adjustments to keep the board from being affected, wherein, as the surfer travels forward and skims across the wave surface, staying on path and avoiding a wipeout becomes a matter of survival. Indeed, one of the significant drawbacks to surfing on a low quality wave is that the board itself can be undesirably diverted, such as, for example, when the tip of the board enters into a chop, in which case, the nose of the board can dive down into the water, which in surf speak is known as 'pearling', and will most often result in a wipeout.

In the past, because there are only a few places in the world where high quality surfable waves are created in nature on a regular basis, it was necessary for surfers to travel great distances to reach and catch a great wave. But given the lack of available time and resources for many surfers to make this type of trip, greater emphasis has been placed on creating man-made surfable waves such as in a large wave pool that surfers can ride on at virtually any time.

Wave pools are man-made bodies of water in which waves are created to simulate waves in an ocean. A wave pool typically has a wave generating machine located at one end and an artificial sloped "beach" located at the other end, wherein the wave generating machine creates disturbances in the water that produce periodic waves that travel from one end to the other. The floor of the pool near the beach is preferably sloped upward so that as the waves approach the shore, the floor causes the waves to change in shape and "break" onto the beach.

One of the shortcomings of traditional wave pools is that they occupy a significant amount of land and therefore are relatively expensive to build. Also, to produce large surfable waves, not only does the pool itself have to be larger, but the wave generators also have to be larger and more powerful to push more water to create the desired waves. Some wave pools have been built with multiple wave generators positioned side by side along the deep end and a sloped beach at the shallow end. The wave generators are capable of being activated at the same time to produce a single periodic wave that travels from the deep end to the shallow end. Typically, in such case, each wave generator is capable of being activated simultaneously to create a single periodic wave that progresses across the length of the pool and then breaks.

In Cohen, U.S. Pat. No. 5,342,145, a wave generating facility having an angled reef for allegedly producing plunging type waves is shown, wherein multiple wave generators are provided at an oblique angle along the offshore side of the reef to generate multiple waves in sequence, wherein a single wave is formed that peels laterally along the reef. In Cohen, the wave generators are positioned at an oblique angle relative to the front or crest of the waves, and likewise, the reef is extended along the same oblique angle, such that, as the waves progress they will peel and break laterally across the reef.

In Leigh, U.S. Pat. No. 3,350,724, a method and apparatus for generating artificial waves in a body of water is shown, wherein multiple wave generators for producing individual waves are shown. According to Leigh, each wave generator is provided with a pair of angled walls extending forward, wherein this arrangement enables the wave segments to elongate as they travel forward. By substantially angling the walls in front of each wave generator, the wave segments are allowed to spread out as they travel forward, which, according to Leigh, allows for longer periodic waves to be produced using fewer and shorter wave generators. According to the drawings, this is achieved by the walls being angled to what appears to be about 60 to 70 degrees relative to each other.

One serious disadvantage of Leigh, however, is that the wave segments elongate as they follow the angle of the walls, wherein the segments will arc radially outward and eventually interfere with and collide against each other as they converge, rather than merge smoothly to form a uniform periodic wave. This is because as the segments elongate a lateral down-line velocity vector is created which causes the wave segments to collide against each other with significant force. The elongation of the wave segments will also, by virtue of the principles of energy conservation, cause the height/amplitude of the waves to drop as they travel forward. Also, the extra turbulence and disturbance caused by the wave segments colliding against each other will cause the waves to redirect energy, thereby further contributing to wave size reduction, wherein additional energy will be required to create the same size wave.

For the above reasons, there is a need to design and build a wave pool using a plurality of wave generators positioned side by side along the deep end to produce wave segments that travel forward and merge together to form a single resultant periodic wave, wherein the pool design successfully allows the wave segments to merge together to form a high quality surfable progressive wave, but without forming excess turbulence and disturbance along the convergence zones.

SUMMARY OF THE INVENTION

The present invention represents an improvement over previous wave pools comprising multiple wave generators positioned side by side, in that the resultant wave formed by merging the wave segments together is a high quality surfable wave devoid of surface instabilities due to improved wave generation and positioning. The wave pool of the present invention has a relatively deep end and a relatively shallow end, wherein the wave generators are located along the deep end, and the shoreline is located along the shallow end, wherein an inclined shoaling floor extends in-between. But unlike past wave pool designs, in the present invention, the wave generators are preferably oriented at an oblique angle relative to the lateral down-line direction of the resultant waves, and staggered, such that, as the wave generators are operated sequentially, one after the other, the wave segments that are produced merge together to form a smoothly shaped resultant progressive wave suitable for surfing that travels across the wave pool shoaling zone and breaks along the breaker line, with reduced turbulence and loss of energy and minimal reduction in size (height/amplitude), etc.

Although different configurations are possible, in one embodiment, the wave pool of the present invention is preferably designed in the shape of a parallelogram (as viewed from above) with the wave generators extended along the deep end and the sloped shoaling floor extended up to the shallow end, i.e., where the breaker line is located, wherein the row of wave generators and breaker line are extended substantially parallel to each other. At the same time, both the row of wave generators and breaker line are, in this embodiment, positioned at an oblique angle relative to the moving front or crest of the resultant progressive wave. And, by keeping the sloped floor and wave generators substantially parallel to each other, and allowing the waves to break at an oblique angle relative to the shoreline, the waves that are formed will break obliquely forward and then peel laterally across the width of the pool. Note that the sloped shoaling floor can also consist of horizontal floor sections with one or more stepped up portions that help create the effect of a sloped floor.

A wave dampening system such as the kind disclosed in Applicant's U.S. Pat. No. 6,460,201, or in U.S. Application Ser. No. 61/200,183, which are incorporated herein by reference, is preferably provided along the shallow end to reduce undesirable wave effects such as rip currents and reverse flows, etc., which can adversely affect the breaking of the waves along the shoreline. A standard shoreline that progresses at an incline from the deep end to the shallow water edge, or other sloped beach, can also be provided.

Preferably, the wave generators are positioned side by side, in a staggered manner, along a predetermined "stagger angle", i.e., along a "stagger line," with each succeeding wave generator in the sequence located further downstream (in the direction of wave travel) than the preceding wave generator. For example, in the travel direction of the waves, the second wave generator is preferably located further downstream than the first wave generator, and the third wave generator is preferably located further downstream than the second wave generator, etc., wherein the last wave generator in the series is located further downstream than any of the other previous wave generators.

With multiple wave generators, including those that are mechanically, pneumatically or hydraulically operated, positioned side by side in this manner, it can be seen that the wave generators must be activated sequentially, one after the other, with a predetermined time interval in between, such that each wave segment has time to progress forward and develop properly before it merges with an adjacent wave segment in the series. And because the wave generators are staggered, it can be seen that in order for the wave segments to merge properly, the activation of each wave generator has to take into account the amount of time it takes for each wave segment to travel forward from one wave generator to the next succeeding wave generator.

One aspect of the present invention for purposes of forming smooth surfable progressive waves is that in front of each wave generator there are preferably a pair of substantially parallel dividing walls that help to confine the energy of the wave segments as they are formed and travel forward before merging. Each pair of dividing walls is preferably extended forward in front of each wave generator such that they help confine the energy of the wave segments, wherein the length, size (height/amplitude) and shape thereof can be substantially maintained as they move forward, while giving them sufficient time to form and develop before converging with other similar wave segments in the sequence. This way, when the wave segments do converge, they can be substantially identical in size and shape, and therefore, undesirable disturbances, interferences, and turbulences, such as excess eddies, flow sheers, and cross directional or secondary waves, etc., can be avoided or at least limited, wherein the size and shape of the resultant waves can be substantially preserved.

A related aspect of the present invention is that in front of each wave generator there are preferably three distinct wave formation zones or areas, which are formed relative to the dividing walls, which can help facilitate the formation, convergence and transition of the resultant progressive waves. These three zones will now be discussed in the order in which they are encountered by each wave segment as they are formed and travel forward.

First, a Wave Formation Zone is characterized by the existence of two substantially parallel dividing walls extended forward directly in front of each wave generator OR either side through which the wave segments travel, wherein the energy of the wave segments is substantially confined and preserved during this period. This Wave Formation Zone is designed to help confine the energy of the wave segments (such as on the bottom, sides and back) as they travel forward so that they can develop a proper shape before entering into the convergence zones and merging together with other like wave segments in the series. In this respect, a characteristic of the dividing walls is that they are preferably extended substantially parallel to each other, although in other embodiments, as will be discussed, they can be "off parallel" to a certain degree, i.e., they can have a slight fade angle, and still achieve similar results. By keeping the dividing walls substantially parallel to each other, or limiting the fade angle, the wave segments will not elongate or lose a significant portion of their energy, or size (height or amplitude), etc.

By extending the two dividing walls in this manner within this Wave Formation Zone, the following advantages can be achieved: 1) the wave segments will not substantially elongate or spread out, which reduces or eliminates the spread speed or down-line radial expansion velocity of the wave segments, which can help prevent the wave segments from interfering with and colliding against each other with excessive force as they merge, and 2) because their wave energy is substantially preserved within the area of the containing side walls, the size (height/amplitude) and shape of the wave segments can be allowed to fully develop, smoothen, and properly form over time throughout the balance of this Zone, which helps to reduce the amount of undesirable disturbances and turbulence that can occur as the wave segments merge. For purposes of this discussion, spread speed or down-line velocity describes a velocity vector moving in a direction that extends longitudinally down the crest or ridgeline of a given wave, which is essentially perpendicular to the forward directional movement of the wave front.

The next (second) zone encountered by the wave segment as it moves forward is the Partial Wave Convergence Zone which is characterized by one dividing wall on one side and open water on the other side, wherein the wave segment begins merging along one side with an adjacent wave segment in the sequence. This Zone extends from the end of the Wave Formation Zone, i.e., at the distal end of the short dividing wall, to the distal end of the long dividing wall. Even though this Partial Wave Convergence Zone only has one dividing wall on one side, and therefore, is not confined on both sides, the wave segment that travels through this Zone is nevertheless confined on the opposite "open" side by the presence of an adjacent wave segment traveling in the same direction. That is, the "open" side will converge with and be confined by an adjacent wave segment in the series which (when the dividing walls are substantially parallel to each other) travels at substantially the same speed, in substantially the same direction, and with substantially the same size (height/amplitude) and shape, wherein the wave segment's energy will be substantially maintained on both sides, i.e., by the wall on one side and the adjacent wave segment on the other side, wherein the convergence and confinement of the wave segments will help maintain the size (height/amplitude) and shape of the resultant progressive wave. Although there is only one dividing wall that directly confines the wave segment, when timed properly, the two adjacent wave segments that merge together will be able to converge together properly, without producing undesirable excess disturbances and turbulence, such as excess eddies, flow sheers and cross directional or secondary waves, which can negatively impact the smooth formation and transition of the desired progressive waves intended for surfing.

The next (third) zone encountered by the wave segment as it travels forward is the Full Wave Convergence Zone which is characterized by open water on both sides, wherein during this Zone the other side of the wave segment merges with another wave segment on the opposite side, wherein the convergence of these wave segments will continue to form the smoothly shaped single resultant progressive wave. This Full Wave Convergence Zone extends just beyond the Partial Convergence Zone, i.e., at the distal end of the long dividing wall, and extends forward into the pool toward the shallow end. But because there is no dividing wall on either side, the wave segment that travels through this Zone will converge with and be confined on the opposite side by another wave segment formed by a succeeding wave generator in the sequence. That is, whereas the wave segment will have already merged on the near side with a preceding wave segment within the Partial Wave Convergence Zone, it will then merge on the opposite side in the Full Wave Convergence Zone with a succeeding wave segment produced by a succeeding wave generator in the sequence on the opposite side. And, because the succeeding wave segment travels at substantially the same speed, in substantially the same direction, and with substantially the same size (height/amplitude) and shape, the energy of these two wave segments will also be substantially confined, such that, as the wave segments converge, a consistently shaped progressive wave will be formed.

As these wave segments travel forward and merge together, one after another, first on one side, and then, on the opposite side, the size (height/amplitude) and shape of each wave segment will remain substantially unaltered, which allows the convergence of these wave segments to help form a substantially smooth progressive wave, wherein undesirable excess eddies, flow sheers, and cross directional or secondary waves, that can negatively impact the formation and transition of the waves, can be reduced or avoided.

While in the preferred embodiment, the dividing walls in front of each wave generator are extended substantially parallel to each other, in other embodiments, the two dividing walls can be off parallel by as much as about 20 degrees, depending on the height of the wave. In this respect, the term "substantially parallel" shall include walls that are exactly parallel as well as those that might be off parallel by a few degrees, whereas, on the other hand, there are other embodiments that have dividing walls with an allowable amount of outward fade greater than just a few degrees, i.e., specific embodiments may have different tolerances that will enable high quality progressive surfable waves to be created (as discussed below).

In this respect, it has been found that the following factors are significant in creating a uniformly shaped progressive wave relative to the fade angle limit discussed above.

First, any degree of outward fade will cause the wave segments to elongate to some degree, wherein, by elongating the wave segment, or allowing it to spread out, a lateral down-line velocity vector will be introduced into the wave segments, which if uncontrolled, can cause cross directional or secondary waves to interfere with and excess flow sheers and eddies to mis-shape the desired surface continuity of the primary surfing wave. Accordingly, one of the objectives of the present invention is to control or limit the fade angle to the extent necessary to reduce these discontinuities to the primary desired surfing wave shape. That is, if wave segment expansion is not controlled by limiting the fade angle of the dividing walls, then, undesirable disturbances and turbulences may result which can spread out, interfere with and collide against each other, and cause bumps, chops, perturbations, eddies and flow sheers to occur. These disturbances can negatively impact the formation and transition of the desired primary surfing wave as it progresses from the generator to the break point (progressively within the pool).

Second, another factor to consider is the relationship that naturally exists between the height of a wave and its wave speed, wherein when the waves are taller, the speed of the waves will necessarily be increased. Therefore, when the waves are taller and the wave speed is increased, the lateral down-line velocity vector of the wave segments will also increase, thereby causing the wave segments to spread out with greater speed and therefore interfere with and collide against each other or by pass each other with greater velocity and force. Accordingly, when the waves are taller, it becomes more critical for the fade angle to be more limited, which can help reduce the spread speed, or lateral down-line velocity that can be created as the wave segments travel forward and merge. For this reason, whereas, when the height of the wave segments is relatively short, i.e., such as around 1.0 meter high, the maximum allowable fade angle between the dividing walls might be around 20 degrees, when the height of the wave segments is relatively high, i.e., such as around 2.0 to 3.0 meters, the maximum allowable fade angle might be reduced to about 5 to 15 degrees, depending on the actual height of the wave segments. The relative depth of the pool floor can also affect the wave speed, wherein this is another factor that should be taken into account when designing the allowable fade angle.

Third, because of the principle of energy conservation, when a wave segment is allowed to elongate (spread out), it necessarily reduces in size (height/amplitude) as it travels forward, and therefore, another factor to consider is the extent to which the wave segments will elongate and decrease in size (height/amplitude) as a result of the fade angle. That is, the higher the fade angle, the more the wave segments will elongate, and therefore, the more the wave segments will reduce in size (height/amplitude), which will ultimately reduce the size and shape of the resultant wave. Accordingly, when the fade angle is high, to produce the same size resultant wave, the wave segments will have to start out higher, which can increase the amount of energy needed to create the wave segments.

Fourth, because any amount of outward fade will cause the wave segments to decrease in height/amplitude over time, as discussed above, the resultant size of any wave segment will depend on how far forward that wave segment travels (between the faded dividing walls) before it converges with another wave segment. And because the wave generators are staggered and operated sequentially, one after the other, by the time any two adjacent wave segments actually do merge, one wave segment will have traveled a greater distance downstream than the other adjacent wave segment, which means that when they do converge, there will be a size (height/amplitude) differential between the two merging wave segments. In other words, because there is a stagger angle, and the wave generators are activated sequentially, one after the other, one of the two merging wave segments will have traveled further downstream than the other, in which case, when there is a fade angle, that wave segment will end up being shorter (in height/amplitude) than the other wave segment prior to entering the convergence zones. As a result, by the time any two wave segments actually merge together, there will be a size (height/amplitude) differential, as well as a lateral down-line width differential (caused by elongation), which is a function of the fade angle. This can cause undesirable disturbances and turbulences, such as excess eddies and flow sheers, to occur.

For the above reasons, when the waves are taller to begin with, not only do the wave segments spread out faster along the same fade angle, but the resultant wave height differential will also increase, wherein the fade angle should be reduced.

While the specific cut off point for the allowable amount of fade angle that can exist between any two dividing walls may be subjective, it is clear that when the fade angle is too great (in proportion to a given wave speed, wave height, stagger angle, or stagger distance, etc.), then, the combination of the differing wave segments interfering with and causing surface disturbances will make it unlikely that a quality progressive wave suitable for surfing can be produced. Accordingly, the present invention contemplates that the above factors be taken into account when designing a wave pool with faded dividing walls.

Based on the above, when the wave segment is equal to or less than about 1.0 meter high, the preferred maximum fade is preferably about 20 degrees or less, whereas, when the wave segment is between about 1.0 meter to 2.0 meters high, the preferred maximum fade will be somewhere between about 10 and 20 degrees, and when the wave segment is 2.0 meters to 3.0 meters, the preferred maximum fade angle will be somewhere between about 5 to 10 degrees depending on the actual height of the wave segment. When in excess of 3.0 meters, the preferred maximum fade angle will be 5 degrees or less. These parameters are intended to be approximate values that can exist between dividing walls, based on the factors discussed above, but other variables relative to the quality of the surfable waves, including the stagger angle, the stagger distance, the depth of the pool floor, the distance that the wave segments have to travel between the dividing walls, and the manner in which the wave segments are created by the wave generators, etc., can come into play and affect those parameters. Ideally, the dividing walls are substantially parallel to each other, but if they are not, then, the fade angle should be limited in the manner discussed above.

BRIEF DESCRIPTION OF THE DRAWINGS

FIG. 2 is a section view of the embodiment of FIG. 1, wherein a wave generator is shown housed within a caisson on the left hand side, and a wave dampening system is shown along the opposite shallow end, wherein a sloped shoaling floor is extended in between;

FIG. 13*a* shows a chart of various embodiments with dividing walls having a fade angle of 5, 10, 15, 20 and 30 degrees, with a starting wave height of 1.0 meters, wherein the chart shows width and wave height differentials, as well as how the convergence speed of adjacent wave segments differ as the fade angle changes;

FIG. 13*b* shows a chart of various embodiments with dividing walls having a fade angle of 5, 10, 15, 20 and 30 degrees, with a starting wave height of 2.0 meters, wherein the chart shows width and wave height differentials, as well as how the convergence speed of adjacent wave segments differ as the fade angle changes;

FIG. 13*c* shows a chart of various embodiments with dividing walls having a fade angle of 5, 10, 15, 20 and 30 degrees, with a starting wave height of 3.0 meters, wherein the chart shows width and wave height differentials, as well as how the convergence speed of adjacent wave segments differ as the fade angle changes;

DETAILED DESCRIPTION OF THE INVENTION

Figure 1:
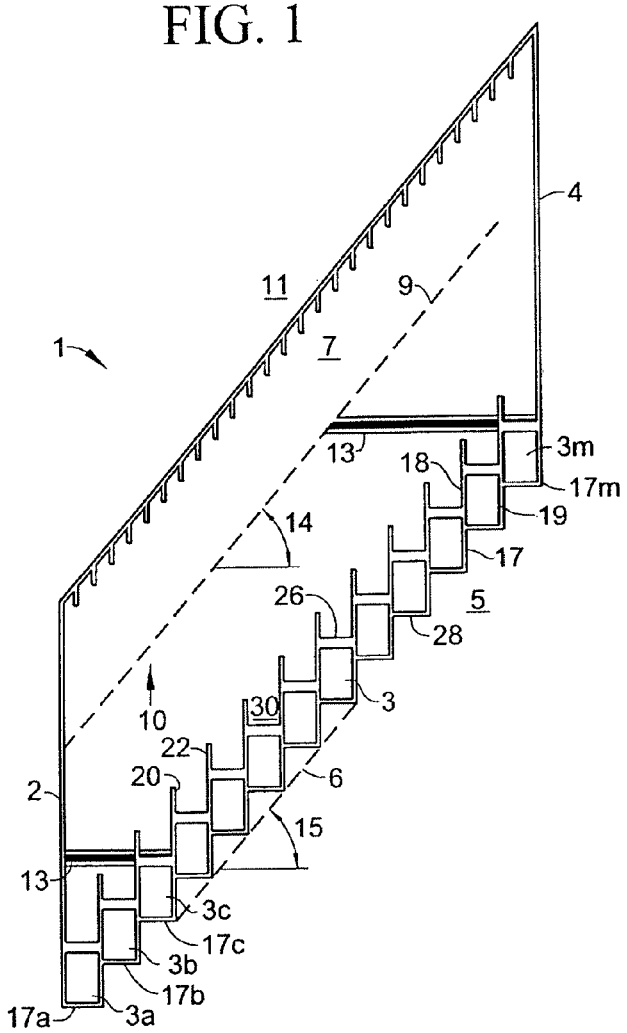
FIG. 1 is a plan view of an embodiment of the present invention wherein the wave generators are extended along the deep end, and the sloped shoaling area is extended along the shallow end, wherein the wave generators and shoaling area are extended substantially parallel to each other, but at an oblique angle relative to the front or crest line of the resultant waves. Two substantially parallel dividing walls are extended in front of each wave generator to help the wave segments form properly before they merge together such that they collectively form a single progressive surfable wave that travels forward from the deep end to the shallow end.

FIG. 1 is a plan view of an embodiment of wave pool 1 having a plurality of wave generators 3 extended along an obliquely oriented stagger line 6, along a relatively deep end 5, with a sloped shoaling floor 21 (identified in FIG. 2), extended along a similarly oriented break line 9, along an opposite shallow end 11. In this embodiment, a series of wave generators 3 (extended along stagger line 6) and sloped shoaling floor 21 (extended along break line 9) are extended substantially parallel to each other, while at the same time, at an oblique angle relative to the lateral down-line direction of the front or crest of waves 13 (which travel in the direction designated by arrow 10). Side walls 2, 4 are preferably extended substantially parallel to each other, and in the wave direction 10, to form the shape of a parallelogram from above.

One aspect of this embodiment is that multiple wave generators 3 are preferably situated and oriented at an oblique angle relative to the front or crest of waves 13, and in a staggered or offset manner relative to the wave direction 10, as shown in FIG. 1. Also, wave generators 3 are preferably housed within multiple caissons 17, wherein each one is preferably staggered or offset relative to each other. For example, second wave generator 3*b*, which is housed within second caisson 17*b*, is preferably located further downstream (in travel direction 10) than first wave generator 3*a* housed within first caisson 17*a*. Likewise, third wave generator 3*c*, which is housed within third caisson 17*c*, is preferably located further downstream than second wave generator 3*b* housed within second caisson 17*b*, etc. And the last wave generator 3*m* in the sequence, which is housed within the last caisson 17*m*, is located further downstream than any other wave generator 3 or caisson 17 in the sequence.

The angle 15 at which stagger line 6 extends relative to the front or crest of wave 13 or the direction that is normal to the travel direction 10 of waves 13 is referred to as the "stagger angle," which represents the degree to which the wave generators 3 are offset relative to each other in the travel direction 10. And, the distance that the front of each caisson 17 is located forward relative to the front of each preceding caisson 17 is referred to as the "stagger distance," which is the distance that each wave segment must travel before it reaches the front of the next succeeding caisson 17. The stagger distance 69 for this embodiment is better shown in FIG. 4.

As shown in FIG. 1, each caisson 17 is preferably in the shape of a rectangle from above, and has a partial front wall 26, a pair of side walls 18, 19, and a back wall 28, and preferably, in front of each caisson 17 there is a pair of dividing walls 20, 22, extending substantially forward in wave direction 10. Preferably, dividing walls 20, 22 are extended substantially parallel to each other, although in alternate embodiments they can have a fade angle of up to about 20 degrees ("off parallel" between them), depending on a number of parameters, as will be discussed. This way, the energy of the wave segments formed by each wave generator 3 can be substantially confined within the space 30 that extends relatively forward in front of each wave generator 3, i.e., between each pair of dividing walls 20, 22. Space 30 is confined on the sides, as well as along the bottom and back. This way, the energy released by each wave generator 3 will be confined on three sides and thus the wave segment will be able to properly form as it travels forward through space 30.

Figure 15:
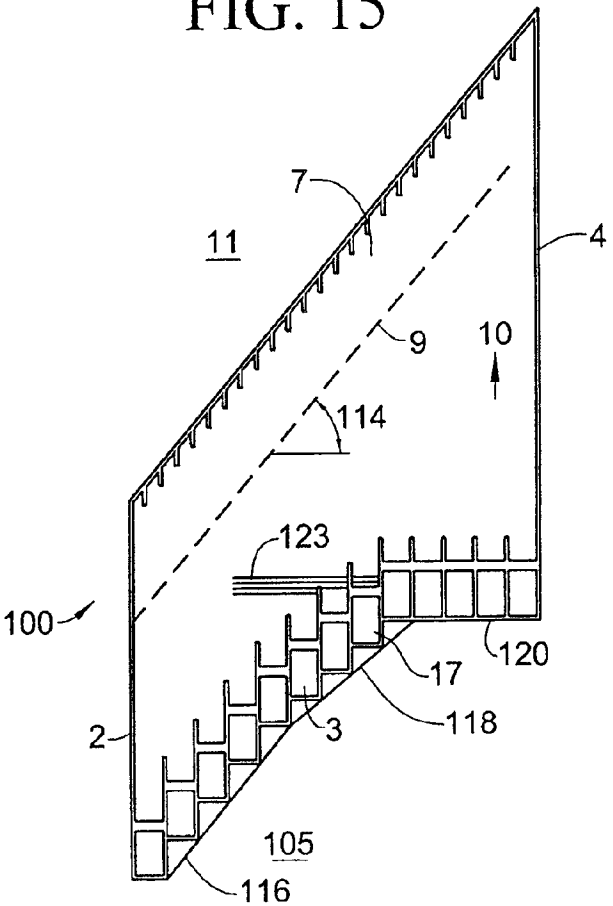
FIG. 15 is a plan view of an alternate embodiment of the present invention wherein the series of wave generators is extended along a varied stagger angle, which begins with the stagger line extending at the same angle as the peel angle, but then, the stagger line becomes shallower, and then, extends in a direction normal to the side walls.
Figure 14:
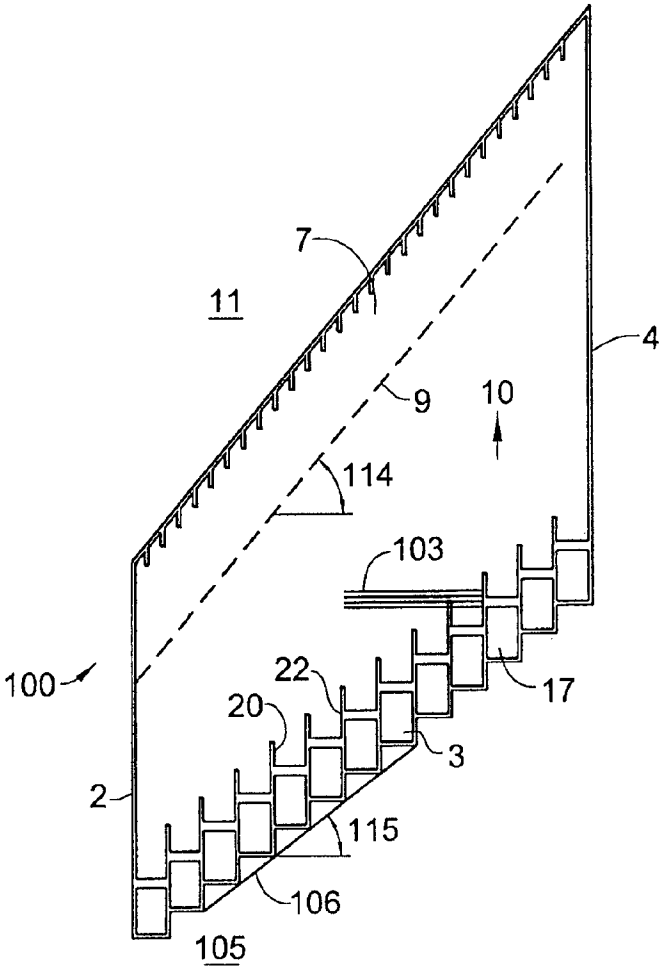
FIG. 14 is a plan view of an alternate embodiment of the present invention wherein the series of wave generators is extended along a stagger angle that is different from the peel angle.

The angle 14 that extends between the front or crest of waves 13 and break line 9 of shoreline 7 is referred to as the "peel angle", which is the angle at which waves 13 will break and peel across break line 9. And, preferably, in this embodiment, pool 1 has a peel angle 14 of about 45 degrees, although it can be within a range of about 30 to 70 degrees, and more preferably, within the range of 40 to 60 degrees, relative to the front or crest of waves 13. The break line 9 doesn't have to be straight, as will be discussed. And, in the embodiment of FIG. 1, the peel angle is preferably the same as the stagger angle, although not necessarily so, wherein both are extended at about 45 degrees relative to the front or crest of waves 13, although in other embodiments, the angles can be greater or smaller, or varied, as shown in FIGS. 14 and 15.

Whether a wave produced by pool 1 is suitable for surfing depends partly on the value of the peel angle $\alpha$. The peel angle should be sufficiently large enough for the lateral down-line velocity of the breaking of waves 13 (extending longitudinally along the length thereof) to be suitable for the skill level of the surfer, as well as the height of the resultant wave formed within pool 1. In this respect, the lateral down-line velocity vector Vs=wave celerity vector c divided by the sine of the peel angle $\alpha$. Thus, when the peel angle is too small, the lateral down-line velocity of waves 13 becomes too fast and therefore the wave becomes too difficult for surfing. Whether a particular surfer can handle a particular wave having a particular lateral down-line velocity depends largely on his or her skill level, but also on the height H of wave 13. And, the greater the lateral down-line velocity is (resulting from a smaller peel angle), the greater will be the skill level required.

The table below shows various surfer skill levels (1 being a beginner and 10 being beyond advanced) as a function of the peel angle and wave height H. Note that a peel angle of 90 degrees is of limited use since there is no progressive slope to cause the waves to progressively break and therefore that value is strictly theoretical. Also note that the practical maximum peel angle that produces a meaningful breaking wave for surfing is about 70 degrees. Likewise, note that the descriptions of the ratings contained in the chart are independent of actual surf break quality or the degree of difficulty of the waves. The chart is taken from Hutt et al. 2001.

| Rating | Description of Rating | Peel Angle Limit (deg) | Min/Max Wave Height (m) |
|---|---|---|---|
| 1 | Beginner surfers not yet able to ride the face of a wave and simply move forward on a whitewater bore as the wave advances. | 90 | 0.70/1.00 |
| 2 | Learner surfers able to successfully ride laterally along the crest of a progressively breaking wave. | 70 | 0.65/1.50 |
| 3 | Surfers that have developed the skill to generate speed by 'pumping' on the face of the wave. | 60 | 0.60/2.50 |
| 4 | Surfers beginning to initiate and execute standard surfing maneuvers on occasion. | 55 | 0.55/4.00 |
| 5 | Surfers able to execute standard maneuvers consecutively on a single wave. | 50 | 0.50/>4.00 |
| 6 | Surfers able to execute standard maneuvers consecutively. Executes advanced maneuvers on occasion. | 40 | 0.45/>4.00 |
| 7 | Top amateur surfers able to consecutively execute advanced maneuvers. | 29 | 0.40/>4.00 |
| 8 | Professional surfers able to consecutively execute advanced maneuvers. | 27 | 0.35/>4.00 |

-continued

| Rating | Description of Rating | Peel Angle Limit (deg) | Min/Max Wave Height (m) |
|---|---|---|---|
| 9 | Top professional surfers able to consecutively execute advanced maneuvers. | Not reach | 0.30/>4.00 |
| 10 | Surfers in the future | Not reach | 0.3/>4.00 |

Thus, it can be seen that the greater the peel angle, the easier it is for a beginner surfer to ride the waves, and the lower the peel angle, the more difficult it would be for a surfer to ride the waves. It can also be seen that the higher the peel angle, the greater the distance that the waves will have to travel downstream along sloped shoaling floor 21, and therefore, the longer the surfers can actually ride the waves successfully. On the other hand, if the peel angle is too high, such as greater than 70 degrees, the waves are not likely to break or break properly, making it difficult for surfing maneuvers to be performed. At the same time, it can be seen that the smaller the peel angle, the more compressed the sloped shoaling floor 21 will be (distance-wise), and therefore, the faster the waves will break along the lateral down-line direction of waves 13, wherein, if the peel angle is too small, i.e., less than 30 degrees, the waves will break extremely quickly, thereby reducing the likelihood that a surfer would have the speed to be able to maneuver on the waves properly. Nevertheless, as waves 13 are formed by wave generators 3 within pool 1 and approach shoreline 7 in the direction of arrow 10, and pass over break line 9, they will begin to break forward and peel laterally, wherein the momentum of the waves will cause them to spill forward and break across the width of pool 1, progressively from one side to the other, i.e., from side wall 2 to side wall 4.

While the peel angle determines the angle at which waves 13 will break relative to sloped shoaling floor 21, the stagger angle determines the angle at which the wave generators 3 are positioned relative to the front or crest of waves 13, or the direction that is normal to wave direction 10. And because wave generators 3 are preferably extended, by virtue of the stagger distance, at an oblique angle relative to the front or crest of waves 13, each wave generator 3 in the sequence, i.e., 3*a*, 3*b*, 3*c*, etc., must be operated sequentially, one after the other, to form individual wave segments that can then merge together to form the resultant progressive wave 13 that travels in wave direction 10. Thus, each wave generator 3 is preferably operated in sequence with a predetermined amount of time elapsing between each one, wherein the time interval that exists between them is preferably equivalent to the time it takes one wave segment to travel from the front wall 26 of one caisson 17 to the front wall 26 of the next succeeding caisson 17 in the series. For example, if it takes 1 second for a wave segment to travel from the front wall 26 of one caisson 17*b* to the front wall of the next succeeding caisson 17*c*, i.e., this distance is referred to as the "stagger distance," then, the preferred time interval between the successive activation of adjacent wave generators 3 should also be 1 second. This helps to ensure that each wave segment formed by each wave generator 3 in succession will merge at the appropriate time, and in the appropriate manner, to form a substantially smooth progressive wave that travels across wave pool 1 in wave direction 10. The timing can be carried out by a computer system that fires each caisson in sequence at the appropriate time.

As for the timing and frequency of the resultant waves 13, they can be determined by the amount of time that elapses between each successive cycle of wave generator 3 activations and therefore waves 13. That is, after the wave generators are activated in sequence for the duration of a given wave period, then, the cycle can repeat itself again by activating the same series of wave generators, i.e., from the first wave generator to the last wave generator in the sequence, for the duration of a given wave frequency period. A time interval of 10 seconds or less to 90 seconds or more between each cycle is possible, which allows sufficient time for the charging and discharging of each wave generator 3, as will be discussed, to be completed before the next cycle begins.

Figure 2:
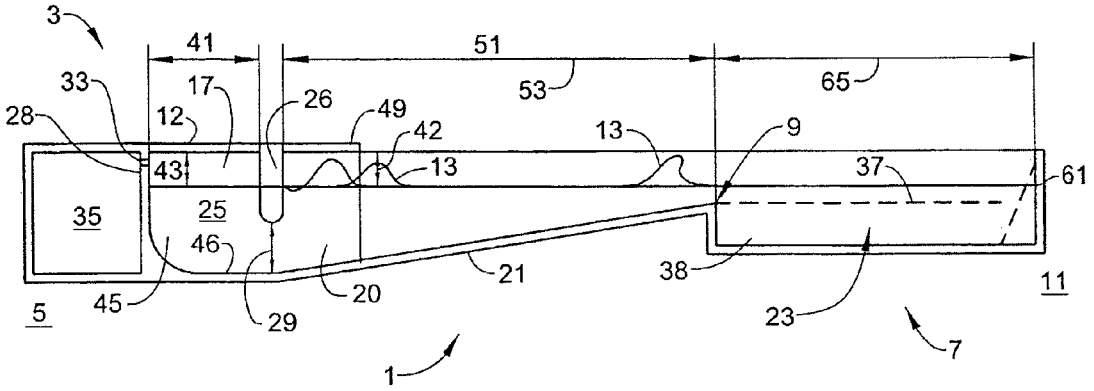

FIG. 2 shows the general cross sectional configuration of pool 1 wherein wave generators 3 are shown extended along deep end 5 on the left hand side and shoreline 7 is shown along shallow end 11 on the right hand side. Extended between deep end 5 and shallow end 11 is preferably a sloped floor 21 that extends along the shoaling section 51 followed downstream by break line 9, and a shoreline 7 that is preferably integrated with a wave dampening system 23, like the one shown in U.S. Application Ser. No. 61/200,183, filed on Nov. 25, 2008, which is incorporated herein by reference. On the other hand, it should be noted that wave dampening system 23 can be omitted and a sloped shoreline 7 of any shape, size or slope could be provided similar to any sloped beach or configuration as is known in the art.

Likewise, sloped shoaling floor 21 can consist of a horizontal floor section with a downstream stepped up portion followed by another horizontal floor section (above the break depth) which can have the effect of causing the wave to begin breaking. Multiple horizontal sections and stepped up portions can also be provided to help create the effect of a sloped floor. For purposes of this discussion and the claims, the term sloped or inclined floor shall include these alternate shoaling floor embodiments.

This view generally shows waves 13 being formed on the water surface emanating from wave generators 3 traveling substantially from the deep end 5 to the shallow end 11, i.e., from left to right. The slope of floor 21 at the wave break zone will be mostly between 2% and 12% (depending on the preferable Iribarren number in the wave break zone). The minimum distance of shoaling section 51 from the caisson front wall 26 to break line 9 and from break line 9 to end wall 61 (dampening area) is normally wave size (height/amplitude) dependant. The Pool 1 structure can be constructed using conventional materials such as concrete with reinforcing bars, etc.

Each wave generator 3 is preferably housed within a caisson 17 which preferably comprises an inverted (up-side-down) watertight column or compartment 25 capable of being filled with air and/or water. Preferably, each caisson 17 has a top wall 12, side walls 18, 19, back wall 28, bottom wall 46, and partial front wall 26, wherein below front wall 26 is preferably a caisson opening 29 of a predetermined height and size which allows water and wave energy to pass forward into pool 1. While other types of wave generators, such as those that are mechanically or hydraulically operated, including those shown in FIGS. 3*a*, 3*b* and 3*c*, can be used and are contemplated by the present invention, the preferred wave generator is pneumatically operated.

Preferably, each caisson 17 has a compressed air chamber 35 immediately behind it, as shown in FIG. 2, in which compressed air can be stored, wherein the compressed air can be released into compartment 25 at the appropriate time. The air fed into and out of compartment 25 can be stored within chamber 35, wherein during the charging phase, air can be drawn out of compartment 25 and into chamber 35, using a pump (not shown), which can cause the water level within caisson 17 to rise (as back pressure within compartment 25 causes water to be drawn from pool 1 and into compartment 25 through caisson opening 29). In such case, the air drawn out of compartment 25 is preferably compressed into chamber 35, where the compressed air can then be stored until it is ready to be released during the discharge phase. Then, at the appropriate time, i.e., when wave generator 3 is ready to be activated, the compressed air within chamber 35 can be released and/or pumped back into compartment 25, which causes water column 45 to drop, which then forces the water within compartment 25 to go down and forward through caisson opening 29, thereby forming wave movements within pool 1.

During the charging phase, because the cavity inside compartment 25 is substantially airtight, when air within compartment 25 is drawn out, the water level within compartment 25 rises, wherein due to back pressure, water can be sucked in from pool 1 through caisson opening 29, and into compartment 25. At this point, the caisson freeboard 43, as shown in FIG. 2, within compartment 25 can be reduced and substantially eliminated, i.e., virtually all of the air within compartment 25 can be withdrawn. By withdrawing air from the top of compartment 25, through valve 33, which is also preferably located near the top, the water level within compartment 25 will naturally rise until such time that compartment 25 is substantially filled with water, which also increases the caisson depth within compartment 25.

By raising the water level within compartment 25, an increased pressure head is created which can be released to force water through caisson opening 29 which can then create wave movements in pool 1. This can be done by gravity alone, or, by releasing the compressed air from chamber 35 into compartment 25, or with an ancillary pump, which provides additional momentum and energy to create larger waves.

This creates a wave 13 directly in front of front wall 26, wherein back wall 28 can be provided with a rounded corner to facilitate the movement of water forward through caisson opening 29.

Figure 3A:
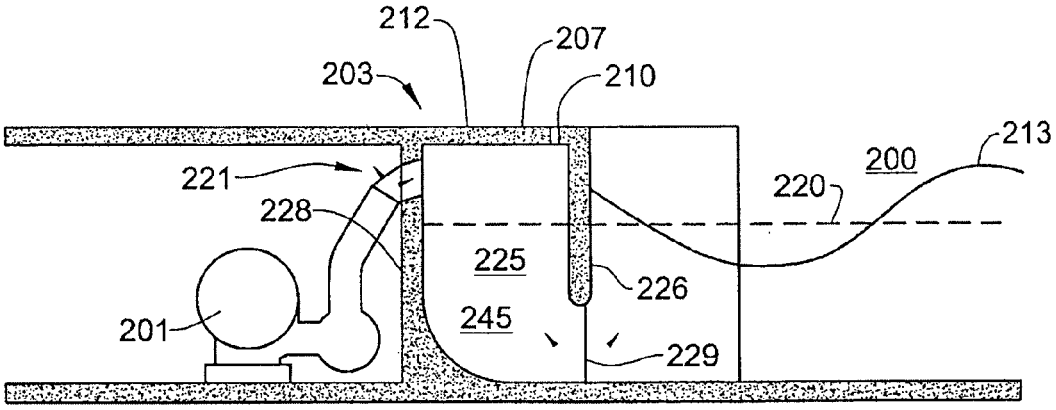
FIG. 3*a* is a section view of an alternate embodiment comprising an oscillatory pneumatic wave generator.
Figure 3B:
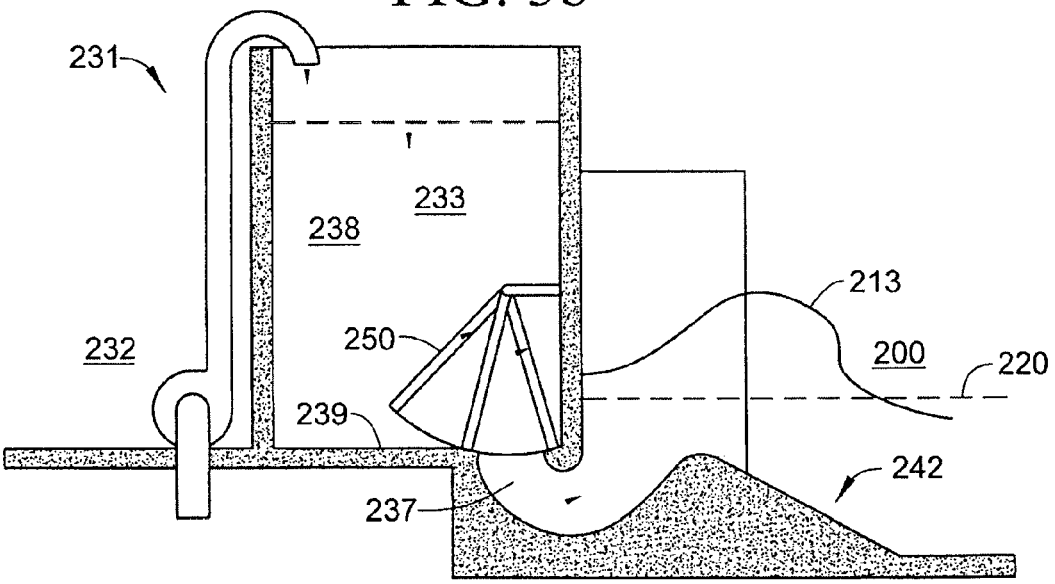
FIG. 3*b* is a section view of an alternate embodiment comprising a surge wave generator.
Figure 3C:
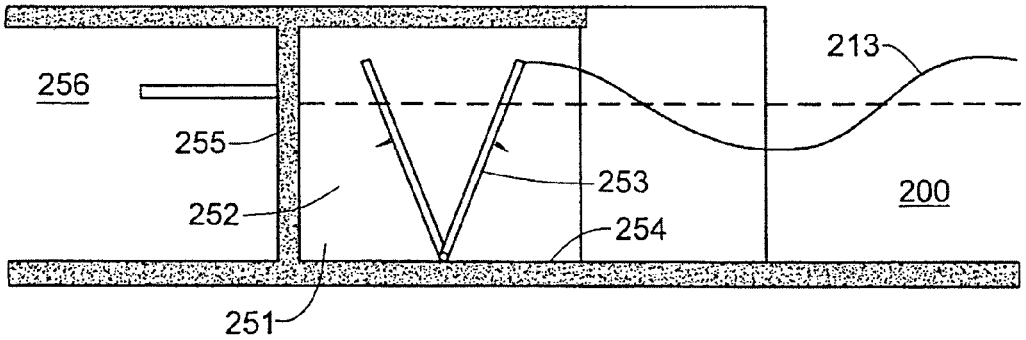
FIG. 3*c* is a section view of an alternate embodiment comprising an oscillatory mechanical wave generator.

Virtually any type of wave generator can be used in connection with the present invention. Three additional types of wave generators that are commonly used in the industry for commercial wave/surf pools are shown in FIGS. 3*a*, 3*b* and 3*c*. One of them is designed for non-periodic surge waves and the two other are designed for oscillatory waves.

FIG. 3*a* shows an oscillatory pneumatic wave generator 203. This wave generator 203 has a concrete caisson 207, with a caisson opening 229 extended below a front wall 226, wherein a blower 201 is provided immediately behind caisson 207 which can inject air into compartment 225. By forcing air into compartment 225 quickly, the water level within compartment 225 can be forced to rapidly drop, wherein the water column 245 within compartment 225 can be forced downward and forward through the point of least resistance, which is caisson opening 229. This causes water to be forced forward into pool 200, which helps to create wave formation 213.

A valve 221 is preferably provided near the top of compartment 225, within back wall 228, through which air can pass from blower 201 into compartment 225. Accordingly, to discharge the air, valve 221 is preferably opened, and when blower 201 is activated, air is pressurized forward through valve 221. When the air has been discharged into compartment 225, and the wave created, wave generator 203 can be charged again by allowing air within compartment 225 to be discharged into the atmosphere, such as through a second opening 210, at or near top wall 212 of caisson 207, wherein by doing so, the water level within compartment 225 can rise again due to the restoring force of gravity, wherein the water level will eventually reach an equilibrium point relative to the water level 220 in pool 200. By doing so, a column of water 245 is then created within compartment 225 which, during the discharge phase, can be forced downward and forward again, through opening 229, to create additional waves 213.

FIG. 3*b* shows a surge wave generator 231 which has a large water storage tank 233 in which water from pool 200 can be stored and released at the appropriate time. A gate 250 is preferably provided near the bottom 239 of tank 233 which can be used to open and close opening 237. With gate 250 closed, pump 232 can be used to fill tank 233 with water, wherein water from pool 200 can be used to increase the water level within tank 233, i.e., above the water level 220 in pool 200, to form a water column 238 having relatively high pressure. This helps to create a relatively high water column 238 as well as a pressure head within tank 233, which when released, i.e., by opening gate 250, can force water column 238 within tank 233 rapidly down and forward through opening 237, thereby creating a bore or surge wave 213.

The amount of water released through opening 237 and the "power" of the water (resulting from the static water level in tank 233), combined with the shape of the step 242 that extends in front of wave generator 231, will define the initial wave height and wave shape. Due to the time it takes for water to refill tank 233 and the relatively large gate 250, these wave shapes are often hard to control and the waves are essentially non-periodic. A disadvantage of this type of wave generator for commercial wave/surf pool applications is that the mechanical parts are mostly situated in water and over time they can corrode and rust, such that mechanical parts may need to be repaired or serviced.

FIG. 3*c* shows an oscillatory mechanical wave generator 251 which has a housing area 252 with a pivoting flap 253 hinged on the pool floor 254 which can be used to push water forward to create wave formations 213 in pool 200. Flap 253 is preferably hinged and can swing back and forth by means of a hydraulic actuator 256 or other mechanical device situated relative to back wall 255 and adapted to create periodic movements within pool 200. The periodic movement of flap 253 results in periodic (sine shape) waves wherein the initial depth of pool 200 and the amount of swing, together with the swing period, can determine the wave height and wave shape. A disadvantage of this type of wave generator for commercial wave/surf pools is that mechanical parts are situated in water and therefore they tend to need repair or service periodically.

By using wave generators 3 (or virtually any generator similar to the kind discussed above), wave segments are created and then merged together, and then, as the resultant waves 13 travel forward, the slope of floor 21 helps to cause the waves to form into a singular swell and begin breaking, such as along break line 9, as shown in FIG. 2. Preferably, floor 21 is extended along a constant slope, and extends upward along an incline from front wall 26 all the way into wave dampening area 23, although, the slope can be varied depending on the type of wave formation desired.

The wave dampening area 23 is preferably extended between break line 9 and far wall 61 of pool 1 along shoreline 7. Wave dampening area 23 preferably comprises a perforated false floor 37, which is extended over a relatively deep floor area 38, which helps facilitate the absorption of wave energy and thereby reduces the energy of the waves, as well as the rip currents and reverse flows that can otherwise occur along shoreline 7. Different versions of the wave dampening system can be used, including those described in Applicant's U.S. Pat. No. 6,460,201, as well as in U.S. application Ser. No. 12/592,464, which are incorporated herein by reference. In the latter, the permeability of floor 37 determines the dampening rate thereof, i.e., the ability of floor 37 to absorb energy and reduce the rebounding effects occurring within pool 1. And by dampening waves 13, and reducing the ancillary wave effects, it becomes possible to increase the frequency of wave production, thereby increasing throughput and facility efficiency.

FIG. 2 shows some of the key dimensions of wave pool 1. For example, it can be seen that the following are shown: The caisson length 41 is the distance that extends between back wall 28 and front wall 26 within each caisson 17. The caisson freeboard 43 is the vertical distance that extends between the top of water column 45 within compartment 25 and the underside of top wall 12. The caisson opening 29 is the opening in front of each caisson 17 which has a vertical distance between the bottom of front wall 26 and bottom floor 46 of caisson 17. Shoaling section 51 has a length 53 which is the distance that extends from front wall 26 of caisson 17 to break line 9, which can vary along the width of caisson 17, since wave direction 10 is oblique relative to break line 9. Floor 21 which forms shoaling section 51 is shown having a constant slope, which extends upward from caisson 17 to break line 9, wherein in the preferred embodiment, the slope can range from 2 to 12 degrees, although not necessarily so.

As referenced in FIG. 1, the height of side walls 2, 4, and dividing walls 20, 22, is shown as the freeboard 42 in FIG. 2, which is preferably higher than the highest possible wave that can be created within pool 1. The freeboard 42 can range from between about 2 feet to 10 feet or more to ensure that any wave formed within pool 1 can be maintained by walls 2, 4, 20 and 22. It should also be noted that dividing walls 20, 22, and walls 2, 4, to the extent applicable, help to allow the wave segments to be formed and developed properly and consistently as they travel forward before merging with other wave segments downstream. This way, when the wave segments merge/converge, the likelihood of forming undesirable eddies and flow sheers within the convergence zones that can inhibit the proper formation of a smooth progressive wave can be reduced. The dampening distance 65 is the distance that extends between break line 9 and the upper edge of floor 37 along back wall 61.

Figure 4:
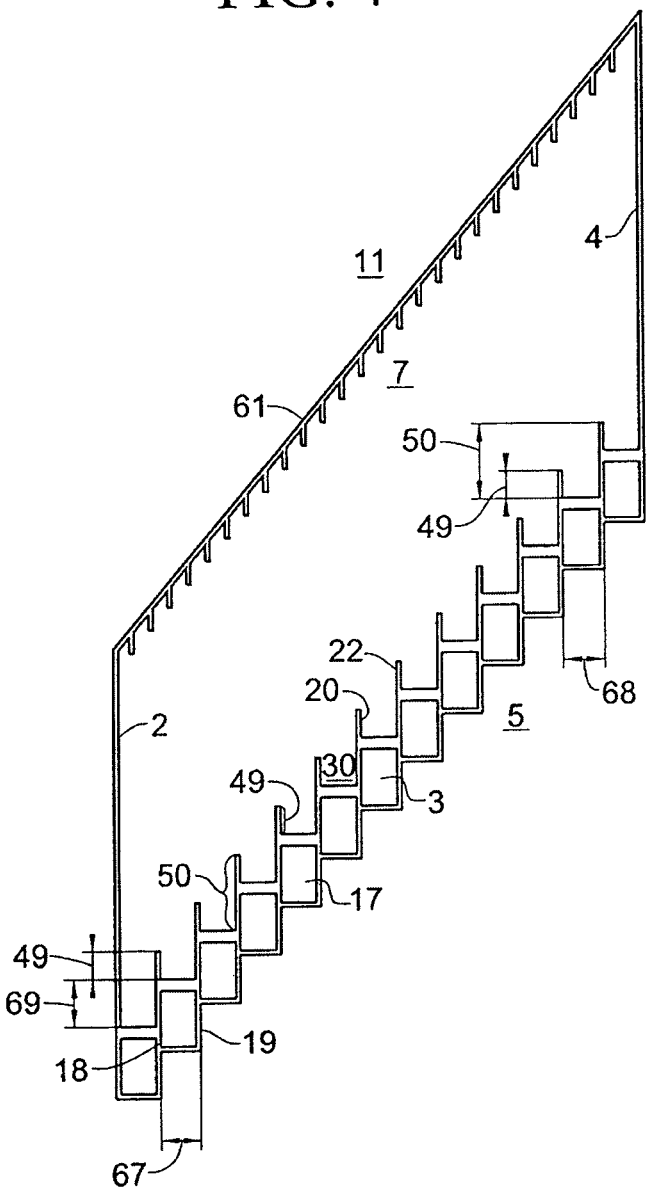
FIG. 4 is another plan view of the embodiment of FIG. 1, showing some of the same features as FIG. 1, but in this view, several dimensions are specified and referenced.

In FIG. 4, the caisson width 67 is shown to be the distance that extends between side walls 18, 19, whereas, the stagger width 68 is a similar width, except that it extends between the center lines of the caisson side walls 18, 19, i.e., from center to center, on each caisson 17. In this respect, it should be noted that the preferred stagger width 68 is preferably about the size of twice the length of a surfboard, i.e., from about 2.5 to 5 meters wide, which is based more on practical fabrication considerations than factors necessary to form a smooth wave. Dividing walls 20, 22 are preferably extended a distance 49, 50 forward, respectively, relative to front wall 26 of each caisson 7, wherein 49 is the distance from front wall 26 to the distal end of short dividing wall 20, and 50 is the distance from front wall 26 to the distal end of long dividing wall 22, on the opposite side, as shown in FIG. 4.

The caisson offset 69 or stagger distance is the distance from front wall 26 of one caisson 17 to the front wall 26 of the next succeeding caisson 17, which is also the distance that each wave segment must travel before the next succeeding wave generator is activated. In this respect, it should be noted that the stagger efficiency is related to the fact that in a series of identical caissons with identical caisson offsets 69, the most efficient pool design, relative to its size and footprint, is one where the stagger angle is equal to the peel angle, and the shoaling distance 53 for the initial caisson 17 is kept to a minimum (thus allowing the wave to form and break while avoiding reflective wave formations that can result if the shoaling distance is too short).

The preferred stagger angle 15 can be determined as follows: the stagger angle 15 can be any angle, but in general, it should not exceed the peel angle 14. The stagger angle 15 can also vary over the width of pool 1, although preferably, it is a constant angle, as shown in FIG. 1. In general, at maximum stagger efficiency, the stagger angle is equal to the peel angle, although, for aesthetic design purposes, or where alteration of shoaling distance 53 is desired (e.g., to save on construction costs, or satisfy local site conditions), variability in the range of the stagger angle is permitted. The limitations on the extreme range of stagger angles are the following: (1) if the stagger angle exceeds the peel angle, then, at some point, the minimum shoaling distance 53 to wave break distance will become too small and the waves will not break properly for surfing purposes; and (2) if the stagger angle is less than the peel angle, then, the shoaling distance 53 for waves 13 becomes larger, which can increase the overall size and cost of the pool and potentially jeopardize its economic viability.

Figure 5:
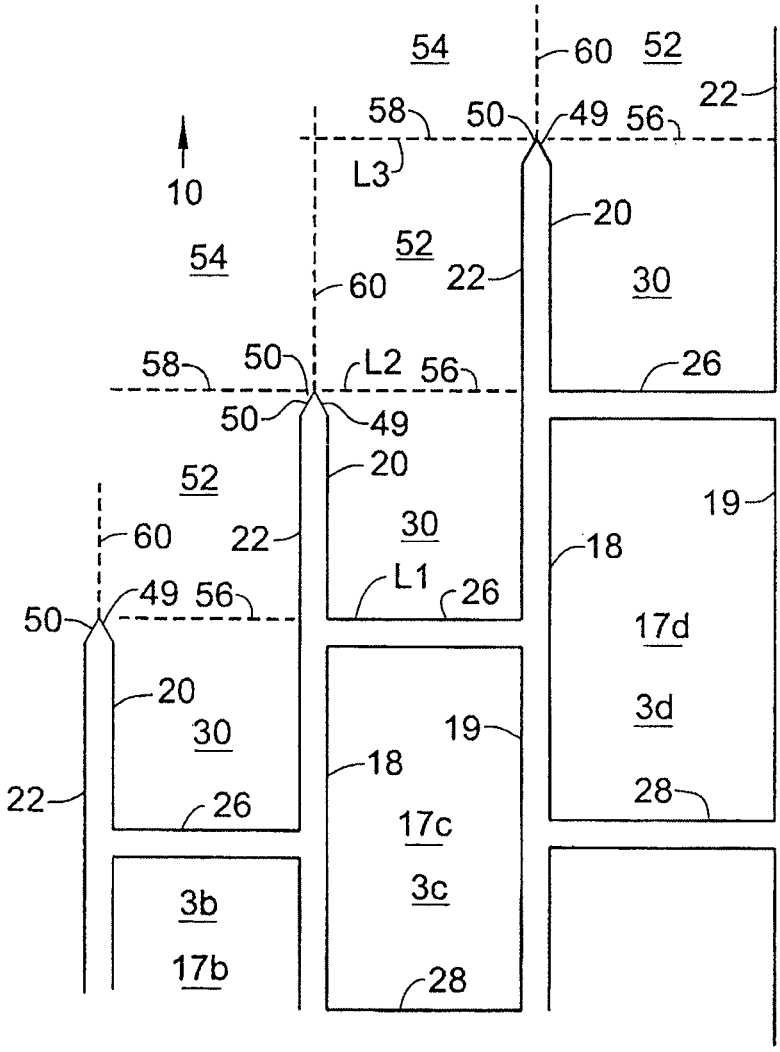
FIG. 5 is a detailed plan view of the staggered caissons of the embodiment of FIG. 1, wherein two substantially parallel dividing walls are extended in front of each wave generator, and three wave formation and convergence zones are created in front of each caisson.

FIG. 5 is a detailed view of each caisson 17*b*, 17*c*, 17*d*, etc., where there are preferably two dividing walls 20, 22 extended in front of each wave generator 3*b*, 3*c*, 3*d*, etc., where one is provided on either side of each space 30. The distance from front wall 26 to distal end 49 of short dividing wall 20 is preferably shorter (in the travel direction 10) than from front wall 26 to the distal end 50 of long dividing wall 22, which is a function of the stagger angle and stagger distance. It can be seen that between adjacent wave generators 3*b*, 3*c*, 3*d*, short dividing wall 20 preferably shares a common wall with long dividing wall 22 of the preceding caisson in the series, and, in the preferred embodiment, it can be seen that long dividing wall 22 of each caisson 17 is preferably formed by a combination of the succeeding caisson's side wall 18 (along the first half of wall 22) and the reverse side of that caisson's short dividing wall 20 (along the second half of wall 22). The distal ends of dividing walls 20, 22 can be tapered or pointed as shown to allow for a smoother transition when wave segments merge. In this respect, since concrete cannot be made too thin, a separate steel or fiberglass sheath can be provided and extended forward at the distal ends of walls 20, 22, forming a narrowed or tapered flange, which can help the wave segments converge more smoothly.

Preferably (as shown in FIG. 4), when the stagger angle is 45 degrees, the stagger width 68 is substantially equal to the stagger distance 69. Accordingly, when each caisson 17 is 4.0 meters wide, then, the preferred stagger distance would also be 4.0 meters. Also, short dividing wall 20 preferably extends forward about the same distance as the stagger distance 69, although not necessarily so. And, in this case, the distance 49 that short dividing wall 20 extends forward in front of front wall 26 is preferably about half the distance 50 that long dividing wall 22 extends forward in front of front wall 26, particularly when the stagger angle is about 45 degrees. The actual distance preferably takes into account the stagger angle and stagger distance, as well as the height of the wave segment, and the depth of the deep end 5 of pool 1, as these dimensions will determine how fast the wave segments will travel, and therefore, how far forward dividing walls 20, 22 should extend relative to front wall 26 to enable the wave segments to form and develop property. The given dimensions and angles are preferably for exemplary purposes only; it should be understood that other distances and angles can be used without departing from the objectives of the present invention.

A notable aspect of the present invention is that in front of each caisson 17, multiple wave formation and convergence zones are preferably created by dividing walls 20, 22. For example (as shown in FIG. 5), directly in front of each wave generator 3, there is preferably a Wave Formation Zone 30, and then, just beyond Zone 30 there is preferably a Partial Wave Convergence Zone 52, and then, just beyond Zone 52 there is preferably a Full Wave Convergence Zone 54. Each Zone, 30, 52 and 54, is preferably defined relative to its distance downstream from the front wall 26 of each wave generator 3, and how far dividing walls 20, 22 extend forward from caisson 17. For example, Wave Formation Zone 30 preferably extends forward from front wall 26 to the distal end of short dividing wall 20, i.e., until dashed line 56, whereas, Partial Wave Convergence Zone 52 preferably extends from the distal end of short dividing wall 20 to the distal end of long dividing wall 22, i.e., until dashed line 58. Full Wave Convergence Zone 54 then extends forward from the distal end of long dividing wall 22, and extends forward into pool 1 beyond dashed line 58.

Each wave segment formed by each wave generator 3 preferably converges along convergence line 60 which extends forward in front of each dividing wall 20, 22 on either side of wave generators 3. An improvement associated with this embodiment is how dividing walls 20, 22 affect the formation and transition of the wave segments created by wave generators 3 before and during the convergence zones thereof, as will be discussed.

The first Wave Formation Zone 30 is defined in the rear by front wall 26 and on the sides by the two dividing walls 20, 22 in front of each wave generator 3 and in the front at the point where short dividing wall 20 ends—as shown by dashed line 56. Because in this embodiment the two dividing walls 20, 22 are extended substantially parallel to each other, and are extended forward on either side, as the wave segment travels forward, its energy is substantially confined on either side (as well as along the bottom and back), such that the wave segment does not elongate or spread out, does not decrease in height/amplitude, and the wave energy is substantially conserved. It can be seen that this Zone 30 initially helps to confine the energy of the wave segments so that they can develop properly over time and so that they will not elongate or lose a significant portion of their energy or become reduced in height/amplitude or shape before merging with other wave segments downstream.

A characteristic of dividing walls 20, 22 is that they are preferably extended substantially parallel to each other, although in other embodiments, they can be "off parallel" by up to about 20 degrees or less, as will be discussed. By extending the two dividing walls in this manner, the following advantages can be achieved: 1) as the wave segment from wave generator 3 moves past front wall 26 and into Zone 30, it needs time and distance within a side-confined but free surface area to properly form into a proper and smooth wave shape. Dividing walls 20, 22 provide such confinement, while the free surface wave shape takes effect. In other words, in order to properly form a smoothly formed wave shape, there should be a free surface transition zone immediately adjacent wave generator 3, in the direction of wave travel 10, that is confined by side walls and on the bottom and back, but open to the air on top, thereby channeling the initiating kinetic energy/mass transport provided by wave generator 3 into a properly smooth shaped gravity induced wave segment; 2) as the wave segments travel forward, they will not substantially elongate, which can help prevent the wave segments from interfering with or colliding against each other in the convergence zone, and 3) because the wave segments are confined, and the energy of the wave segments is substantially aligned, their height/amplitude and shape will remain substantially similar, which helps to keep the wave segments in a substantially constant state-size-wise, height-wise, amplitude-wise and shape-wise—as they eventually merge.

The next area encountered by each wave segment is Partial Wave Convergence Zone 52 which is characterized by a dividing wall 22 on one side and open water on the opposite side, wherein this Zone 52 preferably extends from the distal end of short dividing wall 20 (along dashed line 56) and ends along the distal end of long dividing wall 22 (along dashed line 58). Even though this Zone 52 does not have two dividing walls to confine the wave segment on both sides, the wave segment that travels through this Zone 52 is nevertheless confined on the opposite side by the presence of an adjacent wave segment traveling in the same direction, along convergence line 60. That is, the "open" side of this Zone 52 will be confined along convergence line 60 by an adjacent wave segment (formed by the preceding wave generator 3 in the sequence) traveling at substantially the same speed, in substantially the same direction, and with substantially the same size and shape, and therefore, the energy of this wave segment will be substantially maintained on both sides. Accordingly, the convergence of these wave segments will help maintain the size (height/amplitude) and shape of both wave segments, wherein together, they can begin forming a portion of the resultant progressive wave within pool 1. Although there is only one dividing wall that directly confines the wave segment through this Zone 52, when the formation of the adjacent wave segment from the previous wave generator in the sequence is timed and coordinated properly, then, the two wave segments will form and merge together properly, such that their convergence will remain relatively smooth and produce little or no undesirable side effects, including undesirable eddies and flow sheers.

The next (third) area encountered by the wave segment is the Full Wave Convergence Zone 54 which is characterized by open water on both sides, wherein this Zone 54 extends beyond the distal end of long dividing wall 22, i.e., beyond dashed line 58. After one side of the wave segment has initially merged within Zone 52, the wave segment in this Zone 54 will begin to merge on the opposite side, i.e., with another wave segment traveling in the same direction, wherein the convergence of the two wave segments occurs along another convergence line 60 on the opposite side thereof. Because there is no dividing wall on either side, the wave segment that travels through this Zone 54, which has already merged on one side through Zone 52, will begin merging on the other side, with the next adjacent wave segment formed by the next wave generator 3 in the sequence. And, by ensuring that the succeeding wave segment travels at substantially the same speed, in substantially the same direction, and with substantially the same size and shape, the energy of this segment will also be confined on both sides, such that as the two wave segments converge, they will continue to form a uniformly shaped single progressive wave 13.

As these wave segments merge together in this manner, i.e., along convergence lines 60, with other wave segments in the series, first on one side, and then, on the opposite side, the size (height/amplitude) and shape of each merging wave segment preferably remains substantially unaltered, such that collectively, they can form a uniformly sized and shaped progressive wave 13. And because the size and shape of each adjacent wave segment are preserved, the convergence of these wave segments remains substantially smooth and disturbance-free, wherein undesirable cross-directional and secondary wave formations, eddies and flow sheers that can negatively impact the generation and transition of the waves can be reduced or eliminated.

Because Wave Formation Zone 30 represents a fully confined area characterized by two dividing walls 20, 22 extended in front of each caisson 17, it can be seen that the energy of the wave segment traveling through space 30 is neither dispersed nor dissipated, and therefore, the size (height/amplitude) and shape of the wave segment will remain substantially unaltered prior to entering into Convergence Zones 52 and 54. Accordingly, this Zone 30 preferably enables the wave segments to form properly before they merge, and prevents the wave segments from elongating, shrinking, collapsing or losing energy, etc., such that when the wave segments converge, they do so within Zones 52 and 54, without excess turbulence or disturbance, wherein the size (height/amplitude) of the wave segments will remain substantially constant from one wave segment to the next.

Figure 6:
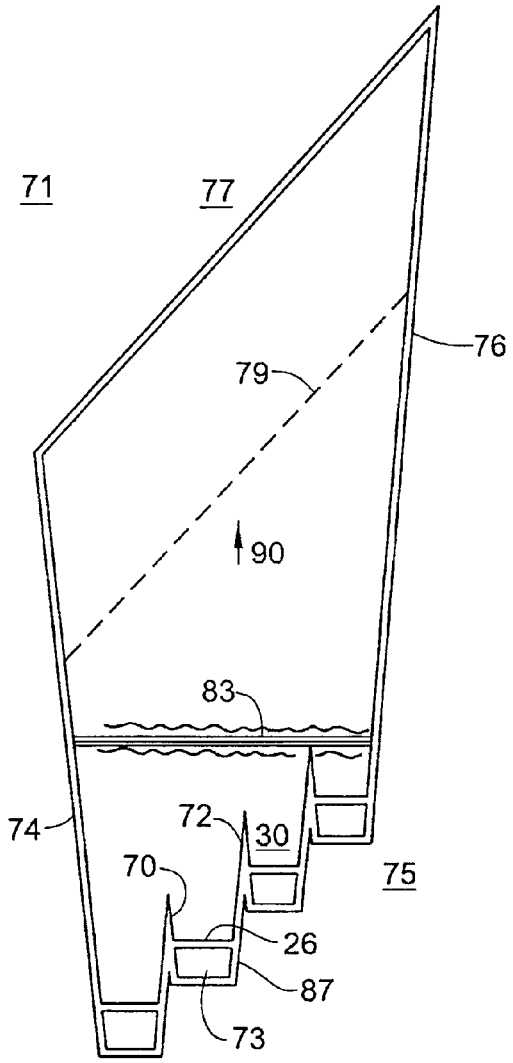
FIG. 6 is a plan view of an alternate embodiment similar to the embodiment of FIG. 1, except that the dividing walls in front of each wave generator are extended at a slight angle relative to each other, i.e., they can have an outward fade angle of up to 20 degrees or less, wherein the side walls of the pool are also extended at about the same angle.

FIG. 6 shows an alternate embodiment 71 with dividing walls 70, 72 which have a fade angle of up to about 20 degrees or less relative to each other—up to about 10 degrees fade angle on each side. This embodiment is substantially similar to the previous embodiment in that it preferably has wave generators 73 extended along a relatively deep end 75, with an oblique stagger angle extended relative to the front or crest of waves 83. It also preferably has a sloped shoreline 77 that extends along break line 79 that extends substantially parallel to wave generators 73, which results in the peel angle and stagger angle being substantially the same. Another difference is that side walls 74, 76 on either side of pool 71 are preferably extended at about the same angle as dividing walls 70, 72, i.e., although not necessarily so.

Because of the fade angle that exists between dividing walls 70, 72, it can be seen that wave generators 73 and associated caissons 87 are spaced further apart from each other, and also, a fewer total number of wave generators 73 are required to be installed across the same width. This is because, with angled dividing walls 70, 72, each space 30 extending between each pair of dividing walls 70, 72, as well as each dividing wall itself, will be wider, and therefore, each wave generator 73 will be spaced further apart. Likewise, because a portion of the total width of pool 71 is taken up by the width of each dividing wall 70, 72, a fewer number of wave generators will need to be installed within the same width.

In any case, when there is a fade angle that exists along dividing walls 70, 72, the angle of the dividing walls can influence how the wave segments will develop and transition as they travel downstream, as discussed above, wherein several factors are preferably taken into account to ensure that a uniformly shaped, smooth progressive wave 83 can be formed within pool 71, as follows:

First, because any degree of fade will cause the wave segments to elongate or spread out, which in turn, can create a lateral down-line velocity vector (extending longitudinally along the down-line width of wave 83), the adjacent wave segments can interfere with each other and/or collide against each other. Thus, it is desirable to limit the fade angle to the extent necessary to reduce or even eliminate this tendency. By limiting the fade angle, the spread velocity of each wave segment can be reduced, wherein, the additional wave effects that can otherwise create undesirable disturbance and turbulence such as cross-directional and secondary wave formations, eddies and flow sheers, can be limited.

Second, another factor to consider is the relationship that exists between the height of a wave and its wave speed, wherein when the waves are taller, the forward speed of the waves will also be increased. Therefore, when the wave speed is increased, the spread velocity produced as the wave segments elongate along the fade angle will also increase, thereby causing the wave segments to interfere with and/or collide against each other with greater force or by pass each other with greater speed as they converge. Accordingly, when the waves are taller, it becomes more important for the fade angle to be more limited, which helps to reduce the lateral velocity that can be created as the wave segments travel downstream along the fade.

For this reason, when the wave height is relatively short, the maximum allowable fade angle between the dividing walls might be around 20 degrees or so, whereas, when the wave height is relatively tall, the maximum allowable fade angle might be lower, such as about 5 degrees or less. The relative depth of the pool floor can also affect the wave speed, so this is another factor that should be taken into account when designing the allowable fade angle. These amounts are just approximations and because wave quality can be subjective, these are not intended as specific limitations on the allowable fade.

Third, because of the principle of energy conservation, whenever a wave segment is allowed to elongate, it necessarily means that the height/amplitude of the wave will subsequently decrease, and therefore, another factor to consider is the extent to which the wave segments will be shorten in height as a result of a higher fade angle. That is, the higher the fade angle that exists between dividing walls 70, 72, the more the wave segments will elongate, and therefore, the more the wave segments will reduce in height/amplitude, which will also reduce the height/amplitude of the resultant wave 83. Accordingly, when the fade angle is too high, to produce the same size resultant wave, the wave segments will have to start out taller, which in turn, will increase the amount of energy needed to create the initial wave segments, which means that the wave generators will have to be larger and/or expend more energy to achieve the same size resultant waves. For these reasons, it is important to take into account the fade angle that exists between dividing walls 70, 72, which helps to ensure that the height/amplitude of the resultant wave can be preserved.

Fourth, because wave generators 73 are staggered, as discussed above, it can be seen that when two adjacent wave segments converge, one of the two wave segments will have traveled further downstream relative to the wave generator that created it than the other wave segment. And, in such case, because the fade angle will cause each wave segment to shorten in height/amplitude over time, i.e., at a particular rate as it progresses downstream, the relative height/amplitude of the two merging wave segments will not be equal at the time they converge. That is, as the wave segments merge together, one wave segment will have traveled further downstream from its point of origin than the other wave segment, and thus, will have decreased in height/amplitude more so than the other wave segment, such that when the two wave segments converge, there will be a wave height differential that exists between the two adjacent wave segments. Accordingly, by the time the two wave segments merge together, not only will there be an width differential, but there will also be a wave height differential, which can potentially cause undesirable disturbances and turbulences to occur.

In other words, because of the stagger angle, and the need for each wave generator to be activated sequentially, one after the other, in sequence, one wave segment will have traveled further downstream than the other wave segment in the series, in which case, when there is a fade angle, one wave segment will be shorter than the other by the time they enter the convergence zone. As a result, by the time the two adjacent wave segments merge together, there will be a wave height/amplitude differential, which is a function of the fade angle that exists between the two dividing walls, which can cause undesirable disturbances and turbulences, such as cross-directional and secondary wave formations, eddies and flow sheers, to occur. And when the wave height is taller to begin with, the wave height differential will also be increased, and accordingly, the fade angle will have to be lower.

In any event, while the specific cut off point for the allowable amount of fade that can exist between the two dividing walls may be subjective, it is clear that when the fade angle is too high, and/or when the waves are traveling too fast, or start out too high, and/or when the stagger angle and/or distance is too high, etc., the combination of the wave segments interfering with and/or colliding against each other, and/or the wave height differential being too great, can make it unlikely that a high quality progressive wave suitable for surfing can be produced. Accordingly, the present invention contemplates that the above factors should be taken into account when designing a wave pool of this kind, wherein the amount of excess turbulence and disturbance that can be created will at least partly be a function of the fade angle that exists between the two dividing walls.

Based on the above, when the wave segment is equal to or less than about 1.0 meter high, the preferred maximum fade angle will be about 20 degrees or less. And, when the wave segment is between about 1.0 meter to 2.0 meters high, the preferred maximum fade angle will be somewhere between about 10 and 20 degrees, depending on the actual wave height. And when the wave segment is taller than 2.0 meters, the preferred maximum fade angle will be somewhere between 5 and 10 degrees depending on the actual wave height. These parameters are intended to be approximate values based on the factors discussed above, but other variables relative to the quality of the waves, including subjective factors based on the skill level of the surfer, as well as the stagger angle, the stagger distance, the depth of the pool floor, the distance that the wave segments have to travel between dividing walls, and the manner in which the wave segments are created by the wave generators, etc., can come into play and affect those parameters.

Figure 7:
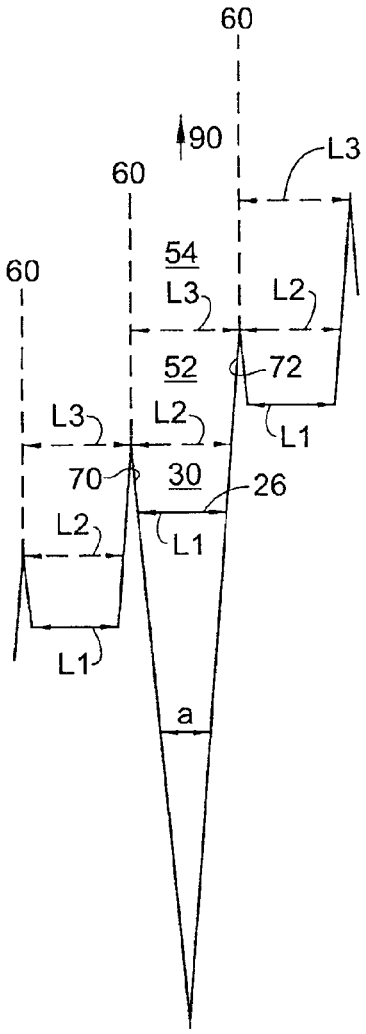
FIG. 7 is a schematic plan view of the alternate embodiment of FIG. 6 wherein three wave formation zones are formed in front of each wave generator, and various length dimensions are specified and referenced.

Next, these factors will be discussed in the context of some mathematical formulas that relate to wave elongation, L1, L2 and L3, and wave height differentials, H1, H2 and H3, and the wave speed and convergence speed differences discussed above Thus, FIG. 7 shows arc length (or width) "D" representing the width of front wall 26 of caisson 87 at the point where the wave segments are created and therefore L1 represents the approximate longitudinal lateral arc length (or width) of the wave segment at the time it is created. Then, as the wave segment travels downstream, in direction 90, and elongates due to the fade angle of dividing walls 70, 72, shown by angle "a," it will have elongated to an approximate arc width "L2," by the time it reaches the distal end of short dividing wall 70. Then, as the wave segment travels further downstream, in direction 90, and continues to elongate, by the time it reaches the distal end of long dividing wall 72, it will have elongated to an approximate arc width "L3."

At this point, between L2 and L3, it can be seen that each wave segment will encounter only one dividing wall 72, i.e., the other side of the wave segment will be in open water and converge with an adjacent wave segment in the sequence which will help confine that side. If all other factors are equal, the total elongation from arc width L2 to L3 may only be about half as much as the elongation from L1 to L2, which is due to the fact that only one side has a dividing wall, and the other side is in open water, converging with an adjacent wave segment, and therefore, is not elongated.

In most embodiments, the downstream distance between L1 and L2 is not likely to be the same as the downstream distance between L2 and L3, in which case, the proportions between them would not be exact. In fact, when there is a stagger angle of about 45 degrees, it can be seen that the distance that long dividing wall 72 extends forward from front wall 26 can be more than twice the distance that short dividing wall 70 extends forward from front wall 26, i.e., the stagger distance 69 is greater than the stagger width 68. This is because, again, each dividing wall takes up more width.

Figure 8:
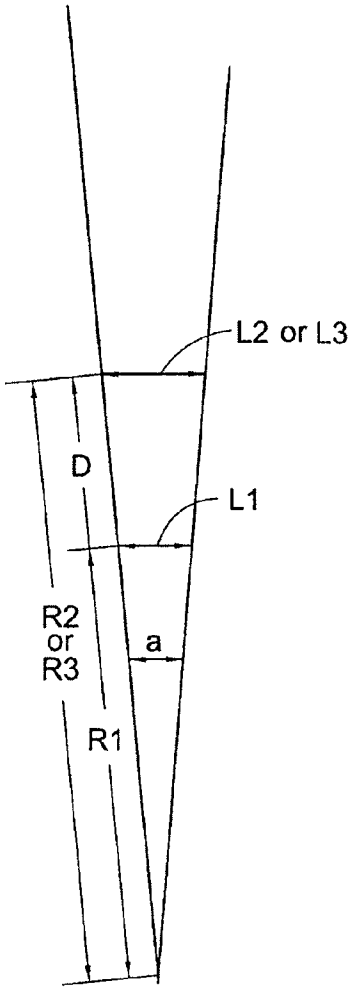
FIG. 8 is a schematic drawing showing the relationship that exists between the various factors pertinent to the embodiment of FIG. 6 and the formulas that are used to determine the length and height differentials that exist relative to the merging wave segments when the dividing walls have a fade angle as shown by angle "a"

FIG. 8 shows and identifies the various factors and relationships associated with the formulas that are used to determine the wave segment arc length (width) and height differentials formed along the convergence zones as well as the spread speed differentials. For example, as discussed above, value "L1" is the approximate arc width of the wave segment at formation, and value "L2" (or L3) is the approximate arc width of the wave segment that occurs at a distance "D" from caisson 87. Angle "a" is the angle of fade between dividing walls 70, 72 in radians, and "R1" is the distance from the apex of angle "a" to L1, and "R2 (or R3)" is the distance from the apex of angle "a" to L2 (or L3). It can also be seen that R1 plus D equals R2.

Figure 9:
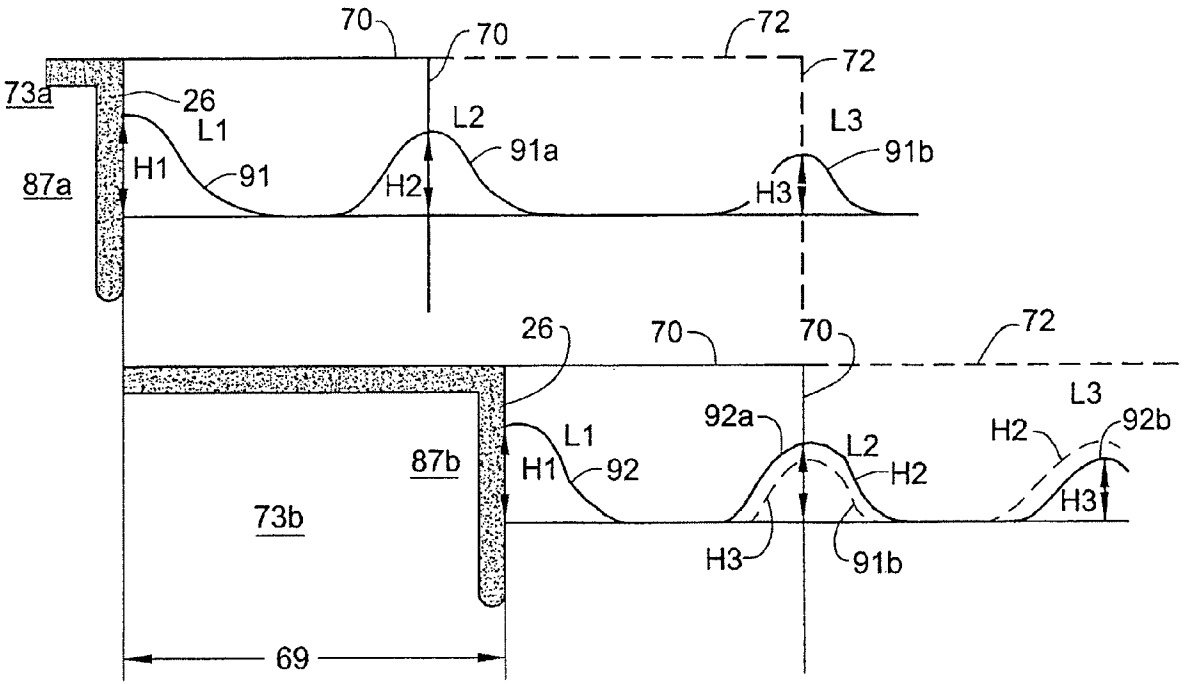
FIG. 9 shows two cross section schematic drawings showing the relative height of two adjacent wave segments formed by two adjacent wave generators in sequence, wherein the top drawing shows a wave segment in time lapse view formed by one preceding wave generator, and the bottom drawing shows a wave segment in time lapse view formed by a succeeding wave generator in sequence, wherein it is shown that the height of each wave segment decreases over time, i.e., from H1 to H2 to H3, wherein because the wave generators are staggered, by the time the two adjacent wave segments merge, they are at different heights.

In reference to FIG. 9, due to the fade angle of dividing walls 70, 72, and the elongation of the wave segments, it can be seen that the height of each wave segment 91 and 92 will continually decrease along the dividing walls as it progresses downstream over an equal depth bottom. For example, the upper drawing of FIG. 9 shows a time lapse view of a wave segment 91 produced by a first wave generator 73*a*, along with the wave segment's relative heights, H1 at 91, H2 at 91*a*, and H3 at 91*b*, as the wave segment progresses downstream. In each case, it can be seen that H1 is taller than H2, and H2 is taller than H3, which indicates that the height of the wave segment 91 decreases over time as it travels forward. The lower drawing shows a time lapse view of another wave segment 92 produced by an adjacent downstream wave generator 73*b*, along with the relative heights of wave segment 92, including H1 at 92, H2 at 92*a*, and H3 at 92*b*, as it progresses. Again, in each case, H1 is taller than H2, and H3 is taller than H2.

In the drawings, "H1" represents the initial wave height at the moment it is created (which has a corresponding lateral arc width L1), and "H2" represents the height of the wave segment at the moment it crosses the distal end of short dividing wall 70 (wherein the wave segment has a corresponding lateral arc width L2), and "H3" represents the height of the wave segment at the moment it crosses the distal end of long dividing wall 72 (wherein the wave segment has a corresponding lateral arc width L3).

At the same time, when the wave segment 92, created by wave generator 73*b* (as shown in the lower drawing of FIG. 9) converges with a previously formed wave segment 91, formed by preceding wave generator 73*a* (which is shown in the upper drawing), the wave segment 92 formed by generator 73*b*, will have a different height than the adjacent wave segment 91 formed by generator 73*a*. That is, while wave segment 91*b* may have a height of H3 (shown in solid line in the upper drawing and in dashed lines in the lower drawing beneath H2), wave segment 92*a* has a height of H2, and thus, there is a wave height differential at the point of convergence between the two wave segments. Likewise, when wave segment 92*b* (formed by wave generator 73*b*) is further downstream, and has a height of H3, the next succeeding wave segment (produced by the succeeding downstream wave generator—not shown) will have a height of H2, which is higher than H3 (H2 is shown in dashed lines above H3 which is shown in solid line), at the time they converge. This same occurrence will repeat in front of each wave generator 73.

As can be seen, when the wave segments actually converge, the relative heights of the two adjacent wave segments will be different, wherein, the wave segment produced by the preceding wave generator in the sequence will be shorter than the wave segment produced by the subsequent wave generator in the sequence. That is, between adjacent merging wave segments, the wave segment produced by the preceding wave generator will be at H3, while at the same time, the wave segment produced by the subsequent wave generator will be at H2. What this means is that when there is a fade angle (in dividing walls 70, 72), there will also be a wave height differential that exists between each pair of wave segments, along convergence lines 60.

Based on the above factors, the following assumptions can be made relative to the lateral arc width differentials (arc-widths L1, L2 and L3) and the wave height differentials (H1, H2, and H3) relative to the wave segments that are formed:

First, as represented in FIG. 8, to determine the lateral arc width differentials, caisson width L1 is assumed to be substantially equal to R1 times "a" in radians, and arc width L2 (or L3) is assumed to be equal to R2 (or R3) times "a" in radians. And, distance D is assumed to be the distance from L1 to L2 (or L3), or equal to R2 (or R3) minus R1. And, based on the above, the following approximations can be assumed: The arc width L2 (or L3) equals the caisson width L1 plus distance D times "a" in radians, or, in other words: L2 (or L3)=L1+(D×a).

Thus, to determine the wave heights, H1, H2, and H3, relative to the arc widths, L1, L2 or L3, and distance D, and angle "a," the following additional assumptions are made: First, the energy in a wave per unit crest width is proportional to the square of the wave height, i.e., E::-$H^2$. Second, conservation of energy then gives $L1 \times H1^2 = L2 \times H2^2$ ($=L3 \times H3^2$). Third, the formula that results is: $H1/H2 = \sqrt{(1+a \times D/L1)}$. Note: this assumes equal depth over distance D.

The following examples will assume that the caisson width L1 is 4.0 meters, and the initial wave height is 1.0 meter, with a floor depth of 2.0 meters, which will mean that the forward wave speed will be about 5.42 meters per second, or about 17.8 feet per second. This is based on the fact that surf waves which are in fact close to solitary waves (i.e. cnoïdal waves with relatively high Ursell numbers) are generated for which the following approximation can be used in relation to the wave amplitude and the water depth: Wave celerity $C=\sqrt{(g \times (A+h))}$, wherein C is the wave celerity, g is the gravity acceleration (which is 9.81 meters per second squared), A is the wave amplitude and h is the water depth. Since surf waves which in fact are close to solitary waves (i.e. cnoïdal waves with relatively high Ursell numbers), the amplitude A will be a high percentage of the wave height (not much trough between peaks) we also can approximate the wave celerity to be close to $C=\sqrt{(g \times (H+h))}$.

Other assumptions described below are provided.

1. Substantially Parallel Dividing Walls:

When dividing walls 20, 22 are exactly parallel to each other, angle "a" is zero, Distances D and L1 are assumed to be 4.0 meters each (which is an assumed value based on the stagger angle being 45 degrees and L1 being the caisson width 67). Thus, the following results can be obtained:

First, with reference to FIG. 5, L2 is substantially equal to L1 (without taking into account the thickness or taper of dividing walls 20, 22), so there is little or no elongation or increase in the lateral down-line or arc width of the wave segments from L1 to L2. Likewise, L3 is substantially equal to L1, so there is little or no elongation of wave segments from L2 to L3.

Second, $H1/H2=\sqrt{(1+((4/4) \times a)))}=1.0$, and therefore, it can be seen that the wave heights at L1 and L2 will be about the same, i.e., H1 is substantially equal to H2, and therefore, as the wave segment travels forward, it will maintain its height. This is also true for wave height H2 to H3. For example, if the wave segment begins at a wave height of 1.0 meter, it will remain substantially at 1.0 meter as it progresses from H1 to H2 to H3. For these reasons, the ideal condition is for dividing walls 20, 22 to be substantially parallel to each other, as shown in FIG. 5, although the distal tips of dividing walls 20, 22 can be tapered to form a tip to enable the wave segments to converge and transition more smoothly, if desired.

Figure 10:
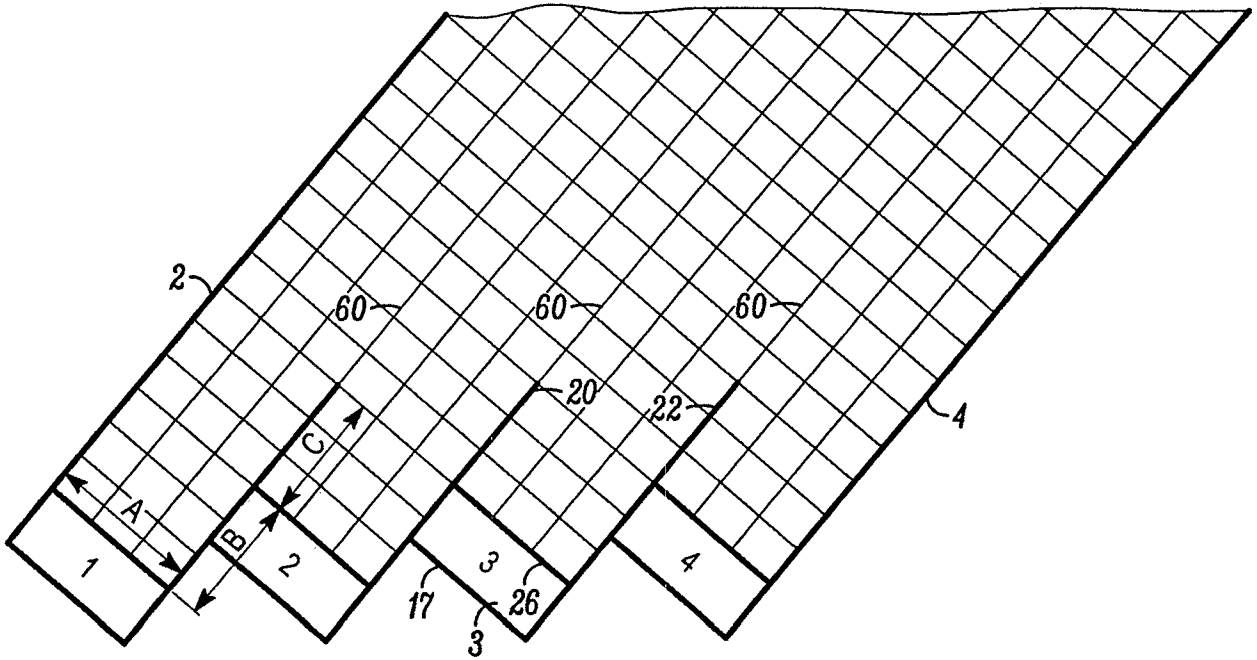
FIG. 10 is a plan view of an embodiment similar to the one shown in FIG. 1, wherein the dividing walls in front of each wave generator are substantially parallel to each other, wherein a grid pattern is shown indicating that the waves and wave segments formed thereby are substantially consistent in size and shape as they travel forward.

As further evidence of these results, and the ideal conditions furnished by dividing walls 20, 22 being substantially parallel, reference is made to FIG. 10, which shows a grid pattern of what the wave segments formed by wave generators 3 will look like as they travel downstream. As can be seen, each wave segment formed by each wave generator 3 substantially retains the same width and length, and therefore shape, even after they merge together, wherein they essentially maintain the same width and length and shape across the length of the pool as the single resultant progressive wave travels toward shoreline 7. Additional details about FIG. 10 and its comparison to FIGS. 11 and 12 will be discussed later.

2. Dividing Walls with Some Fade:

When dividing walls 70, 72 have any degree of fade or are off parallel to any extent, wave generators 73 will necessarily be spaced further apart, and therefore, as can be seen in FIG. 6, when the stagger angle is fixed, i.e., such as at 45 degrees, long dividing wall 72 will extend further downstream than long dividing wall 22 of the previous embodiment 1. That is, when there is any fade, the dividing walls themselves take up more width across the width of pool 71, and therefore, when caissons 87 are extended at the same stagger angle, i.e., 45 degrees, long dividing wall 72 in front of each caisson 87 will necessarily have to be extended further downstream to make up for the extra width of dividing walls 70, 72. And, in the present case, for purposes of illustration only, the amount by which long dividing wall 72 extends downstream than short dividing wall 70 will be estimated to be about D1 plus one third of D1, which might be the case when the stagger angle is about 45 degrees, and the fade angle is about 10 degrees, wherein D1 is the distance downstream from front wall 26 of caisson 87 to the distal end of short dividing wall 70. Accordingly, when D1 is 4.0 meters, then D2 which is the distance from front wall 26 of caisson 87 to the distal end of long dividing wall 72 will be assumed to be about 9.3 meters when D1=L1. Of course, when the fade angle is higher, or the stagger angle changes, this number will change as well, but in these examples, it will be assumed that D2 will remain a constant, i.e., 9.3 meters, which means that as the fade angle changes, the stagger angle will change as well.

Likewise, the stagger distance 69, i.e., the distance that extends downstream from front wall 26 of one caisson 87 to front wall 26 of the next succeeding caisson 87 will also have to be increased by about the same amount. This is for the same reasons, which is that when there is any fade angle, the dividing walls themselves take up extra width across pool 71, and therefore, when caissons 87 are extended along the same stagger angle, i.e., 45 degrees, the front wall 26 of one caisson 87 will necessarily have to be extended further downstream to make up for the extra width of dividing walls 70, 72.

These factors suggest that there will be a greater differential in both wave segment arc width between L2 and L3, as well as wave height differential between H2 and H3, when there is a fade, compared to L1 and L2, and H1 and H2. At the same time, as shown in FIGS. 6 to 9, it can be seen that between L2 and L3, and between H2 and H3, there is only one dividing wall, i.e., 72, that affects the arc width and height of each wave segment, and therefore, to be accurate, the total differential (in arc width and height) will need to take into account only one side. Nevertheless, for purposes of this analysis, it will be assumed that the elongation and wave height differentials that exist along one side will be about the same overall regardless of whether the other side is confined by an adjacent wave segment.

3. Dividing Walls with 10 Degree Fade Angle and Wave Height of 1.0 Meter:

When dividing walls 70, 72 have a total 10 degree fade angle, i.e., 5 degrees on each side, the angle "a" in radians will be 0.1745. D and L1 will be assumed to be 4.0 meters. Based on these assumptions, the following results can be obtained relative to L2: L2=4+(4×0.1745)=4.69 meters, which is an increase of about 0.7 meters.

What this shows is that through the first Zone 30, which extends from caisson 87 to the distal end of short dividing wall 70, or from L1 to L2, the wave segment will elongate about 0.7 meters, which is about 2.3 feet (1.15 feet on each side), i.e., from 4.0 meters to about 4.7 meters. That is, whereas the wave segment begins with an arc width of 4.0 meters, by the time it travels to the distal end of short dividing wall 70, the wave segment will have elongated to an arc width of about 4.7 meters.

What this means is that if the wave segment travels at a speed of 5.42 meters per second, and the distance that it travels through this Zone 30 is 4.0 meters, it will take less than about 1 second, i.e., about 0.74 seconds, to travel that distance (4.0 meters at 5.42 meters per second). Accordingly, the lateral spread velocity of each wave segment at the converging point will be about 0.47 meters per second on each side, which is the speed at which each wave segment elongates (based on 0.35 meters divided by 0.74 seconds). Thus, when the two wave segments converge, they will collide/interfere with a combined convergence velocity of about 0.95 meters per second (0.47 meters per second times two).

As for the height of the waves, in this example, the starting wave height is assumed to be 1.0 meter high, although this amount can vary between about 2.0 feet to about 3.0 to 4.0 meters or more depending on the circumstances. And, given that angle "a" in radians is 0.1745, and D and L1 are assumed to be 4.0 meters, the following results are obtained: H1/H2=√(1+((4/4)×0.1745)))=1.0837.

What this means is that the wave segment will drop in height by a ratio (H1/H2) of about 1.0837 as it travels through first Zone 30, which means that if H1 begins at 1.0 meter at L1, then H2 will end up being about 0.92 meters at L2, which is a drop of about 0.077 meters, or 3.3 inches. This represents the drop in height of the wave segment (based on a 10 degree fade) which occurs in Zone 30, i.e., before the wave segments merge together. Accordingly, this can be expected to occur with respect to each wave segment produced within this embodiment of pool 71.

One additional factor to consider is that because the wave has dropped in height by about 3.3 inches, the wave speed, which started at 5.42 meters per second, will, by the time the wave segment reaches the distal end of short dividing wall 70, slow down to about 5.35 meters per second, wherein the lateral spread velocity of the wave segments will be reduced slightly, i.e., from about 0.95 meters per second to about 0.92 meters per second, or about 0.46 meters per second on each side. While this helps to reduce the impact forces at the moment of collision/interference, this change is relatively insignificant from the standpoint of its total effect.

Nevertheless, because there is a stagger angle that causes the wave segments to merge at different locations along the downstream path, first on one side, and then on the opposite side, it will now be necessary to determine the arc width and wave height differentials at points L2 and L3, where D2 at L2 is equal to 4.0 meters and D3 at L3 is estimated to be about 9.3 meters, which, again, takes into account the stagger angle of caissons 87. Based on the above, the following results can be obtained:

First, relative to the elongated arc width of the wave segments, by the time the wave segment reaches the distal end of long dividing wall 72, or the end of second Zone 52, L3 will be as follows: L3=4+(9.3×0.1745)=5.62 meters.

What this shows is that through the first and second Zones 30 and 52, which extends from caisson 87 to the end of long dividing wall 72, the wave segment will elongate by a total of about 1.62 meters (except that in this case, one side in second Zone 52 will be confined by the adjacent wave segment, whereas, on the opposite side, the wave segment will elongate by about 0.81 meters). Accordingly, if the wave segment takes about 1.72 seconds to travel that distance (9.3 meters at 5.42 meters per second), the lateral spread velocity on that side will be about 0.47 meters per second, which is the speed at which the wave segment will elongate as it converges. Thus, when the two wave segments converge, they will collide/interfere with a combined convergence velocity of about 0.94 meters per second, or about 3 feet per second (without taking into account the change in wave height).

As for the height of the wave segments, with the starting wave height of 1.0 meter, and the angle "a" in radians being 0.1745, and with D now assumed to be 9.3 meters, the following results can be obtained: $H1/H3=\sqrt{(1+((9.3/4)\times 0.1745)))}=1.1856$. In such case, it can be seen that the wave segment will drop as it travels from caisson 87 to the end of second Zone 52 by a ratio of about 1.1856, which means that if H1 begins at 1.0 meter at L1, then H3 will be about 0.843 meter at L3, which is a drop of about 0.156 meters, or about 5.1 inches. This represents the drop in height of each wave segment as it travels from caisson 87 through the first and second Zones 30 and 52, based on a 10 degree fade angle.

At the same time, because the wave has decreased in height by about 5.1 inches, the wave speed, which started at 5.42 meters per second, will, by the time the wave segment reaches the distal end of long dividing wall 72, slow down to about 5.28 meters per second, wherein the lateral down-line spread velocity of the wave segments will also be reduced slightly, i.e., from about 0.94 meters per second to about 0.91 meters per second, or about 0.46 meters per second on each side. While this helps to reduce the impact forces applied at the moment the wave segments converge, this change is relatively insignificant from the standpoint of its effect on the wave segments.

All of the above shows that when the wave segments actually merge together along convergence line 60, one wave segment will be about 0.92 meters high, and the other wave segment will be about 0.843 meters high, which is a height differential of about 0.08 meters, or about 3.15 inches. That is, when the wave segments converge, one wave segment will be about 3.15 inches taller than the other wave segment, which can cause slight disturbances and turbulences to occur. Nevertheless, because the combination of the lateral spread velocity, which tends to cause the wave segments to collide/interfere at about 0.92 meters per second, and the height differential totaling about 3.15 inches, it can be seen that with a 10 degree fade, and a wave height of 1.0 meter, the amount of disturbance and turbulence will not be significant, wherein the waves may be sufficiently formed and smooth enough for purposes of surfing.

4. Dividing Walls with 20 Degree Fade Angle and Wave Height of 1.0 Meter:

When dividing walls 70, 72 have a 20 degree fade (or are off parallel by 10 degrees on each side), the angle "a" in radians will be 0.3491. Distances D and L1 will be assumed to be 4.0 meters. Based on these assumptions, the following results are obtained relative to L2: $L2=4+(4\times 0.3491)=5.396$ meters.

What this shows is that through the first Zone 30, or from L1 to L2, the wave segment will elongate by about 1.4 meters or about 4.6 feet (2.3 feet on each side), so by the time the wave segment travels to the distal end of short dividing wall 70, the wave segment will have elongated or spread to about 5.4 meters.

What this means is that if the wave segment takes about 0.74 seconds to travel that distance (4.0 meters at 5.42 meters per second), the lateral spread velocity on each side will be about 0.94 meters per second, or about 3 feet per second, which is the speed at which each wave segment will elongate on each side, with a combined lateral spread velocity or convergence speed of about 1.88 meters per second, or about 6 feet per second, which is about one-third the forward speed of the wave.

Even though the drop in wave height will tend to slow down the wave slightly, as well as the lateral down-line velocity of the wave segments, as shown before, this should not have a significant effect on the relative velocities of the wave segments.

The starting wave height will be assumed to be 1.0 meter, and given that angle "a" in radians is 0.3491, and D and L1 are assumed to be 4.0 meters, the following results can be obtained relative to the wave height differential: $H1/H2=\sqrt{(1+((4/4)\times 0.3491)))}=1.1615$. This means that the wave segment will drop in height by a ratio (H1/H2) of about 1.1615 as it travels through first Zone 30, which means that if H1 begins at 1.0 meter at L1, then H2 will be about 0.86 meters at L2, which is a drop of about 0.14 meters, or about 5.5 inches. This represents the drop in height of each wave segment based on a 20 degree fade and a starting wave height of 1.0 meters which occurs in Zone 30 before the wave segments merge together.

Again, although another factor to consider is the reduction in wave speed resulting from the drop in wave height, from about 5.42 meters per second, to about 5.30 meters per second, which reduces the combined lateral spread velocity from about 1.88 meters per second to about 1.85 meters per second, this change is relatively insignificant from the standpoint of its total effect on the wave segments. Thus, for purposes of the calculations below, this step will be omitted, as it will be assumed that the impact of this factor will be insignificant.

Because there is a stagger angle that causes the wave segments to merge at two different locations along the downstream path, first on one side, and then on the opposite side, it will now be necessary to determine the arc width and wave height differentials at points L2 and L3, where D2 (at L2) is equal to 4.0 meters, and D3 (at L3) is estimated to be 9.3 meters. Based on the above, the following results can be obtained:

First, by the time the wave segment reaches the end of second Zone 52, L3 will be as follows: $L3=4+(9.3\times 0.34591)=7.22$ meters. What this shows is that through Zones 30 and 52, the wave segment will elongate by about 3.22 meters or about 10.6 feet (except that in this case, one side in second Zone 52 will be confined by the adjacent wave segment, whereas, on the opposite side, the wave segment will elongate by a total of about 1.61 meters or about 5.3 feet). Accordingly, if the wave segment takes about 1.72 seconds to travel that distance (9.3 meters at 5.42 meters per second), the lateral velocity on that side will be about 0.94 meters per second, or about 3 feet per second, which is a combined lateral spread velocity of about 1.87 meters per second or about 6.0 feet per second (without taking into account the reduction in the height of the wave segments caused by the elongation).

With a starting wave height of 1.0 meter, and angle "a" in radians still being 0.34591, and with D assumed to be 9.3 meter, the following results can be obtained: $H/H3=\sqrt{(1+((9.3/4)\times 0.34591)))}=1.343$. In such case, the wave segment will drop through second Zone 52 by a ratio of about 1.343, which means that if H1 begins at 1.0 meter at L1, then H3 will be about 0.745 meter at L3, which is a drop of about 0.26 meters or about 10 inches. This represents the drop in height of each wave segment as it travels through Zones 30 and 52, based on a 20 degree fade.

When the wave segments converge together along convergence line 60, one wave segment will be about 0.86 meter high, and the other wave segment will be about 0.745 meter high, which is a height differential of about 0.12 meter, or 4.5 inches. That is, one wave segment will be about 4.5 inches taller than the other wave segment, which can cause some disturbances and turbulences to occur.

Based on the above, it can be seen that the collision/interference speed of about 1.80 meters per second, and the wave height differential of about 4.5 inches, can cause some undesired disturbances and turbulences to occur which may make a 20 degree fade with a 1.0 meter wave height unacceptable, depending on the desired quality of the waves for surfing.

5. Dividing Walls with 30 Degree Fade and Wave Height of 1.0 Meter:

When dividing walls 70, 72 are off parallel by 30 degrees, the angle "a" in radians will be 0.5236. Distances D and L1 will be 4.0 meters, and based on these assumptions, L2=4+(4×0.5236)=6.09 meters.

What this shows is that through first Zone 30, the wave segment will elongate by about 2.09 meters, or about 6.9 feet (more than 3.4 feet on each side), which means that if the wave segment takes about 0.74 seconds to travel that distance (4.0 meters at 5.42 meters per second), the lateral spread velocity on each side will be about 1.41 meters per second, wherein the combined lateral spread velocity or convergence speed will be about 2.82 meters per second, which is more than one-half the forward downstream speed of the wave.

The starting wave height will be 1.0 meter, and, given that angle "a" in radians is 0.5236, and D and L1 are 4.0 meters, the following are obtained: H1/H2=√(1+((4/4)×0.5236))=1.2343. This means the wave segment will drop by a ratio of about 1.2343 as it travels through first Zone 30, which means that if H1 begins at 1.0 meter at L1, H2 will be about 0.81 meters at L2, which is a drop of about 0.19 meters, or about 7.5 inches. This represents the drop in height of each wave segment through first Zone 30, based on a 30 degree fade.

Because there is a stagger angle that causes the wave segments to merge in two different locations, first on one side, and then on the opposite side, it will now be necessary to determine the arc width and wave height differentials at L2 and L3, where D2 (at L2) equals 4.0 meters, and D3 (at L3) is estimated to be about 9.3 meters. Based on the above, the following results can be obtained:

First, by the time the wave segment reaches the end of the second Zone 52, L3 will be as follows: L3=4+(9.3×0.5236)=8.87 meters. What this shows is that through Zones 30 and 52, the wave segment will elongate by about 4.87 meters or 15.8 feet, i.e., more than double its original arc width, except that in this case, one side within second Zone 52 will elongate by about 2.43 meters.

If the wave segment takes about 1.72 seconds to travel that distance (9.3 meters at 5.42 feet per second), the lateral spread velocity on that side will be about 1.41 meters per second or 4.64 feet per second, with a combined spread velocity or convergence speed of about 2.82 meters per second.

With the starting wave height of 1.0 meter, and the angle "a" in radians being 0.5236, and with D assumed to be 9.3 meters, the following can be produced: H1/H3=√(1+((9.3/4)×0.5236)))=1.489. In such case, the wave segment will drop in height as it travels through second Zone 52 by a ratio of about 1.489, which means that if H1 begins at 1.0 meter at L1, H3 will be about 0.67 meters at L3, which is a drop of about 0.33 meters, or 12.9 inches.

What the above shows is that when the wave segments merge together along convergence line 60, one wave segment will be about 0.81 meters high, and the other wave segment will be about 0.67 meters high, which is a height differential of about 0.14 meters, or about 5.5 inches. Accordingly, one wave segment will be about 5.5 inches taller than the other wave segment, which can cause unwanted disturbance and turbulence, as well as eddies and flow sheers, to occur.

Based on the above, it can be seen that the combination of the lateral spread velocity or convergence speed, which causes the wave segments to collide/interfere at a speed of about 2.67 meters per second or about 8.76 feet per second, and the wave height differential of about 5.5 inches, can cause some disturbances and turbulence to occur are likely to be unacceptable for surfing purposes.

In summary, when there is any fade, the lateral arc width and spread velocity of the wave segment will increase, wherein the height of the wave segment will decrease, wherein as the two adjacent wave segments progress forward, the arc length and wave heights of the adjacent wave segments will end up being different due to the differences in travel distances, such that, by the time they converge, if the fade is high enough, it may be difficult for the wave segments to merge properly to produce smoothly shaped progressive waves. More specifically, when a wave segment begins at an arc width of L1 and a wave height of H1, and then, by the time it merges with another wave segment, one wave segment has an arc width of L2, while the other has an arc width of L3, and likewise, one wave segment has a wave height of H2, whereas, another has a wave height of H3, then, by the time they converge, the differentials will cause additional disturbances and turbulences to occur. Likewise, when the lateral arc widths increase over time, this will tend to cause each adjacent wave segment to collide against each other, i.e., as they crisscross, which may cause significant disturbances and turbulence to occur, which may be too great for purposes of producing smooth surfable waves.

6. Dividing Walls with 20 Degree Fade Angle and Wave Height of 2.0 Meters:

When the wave is 2.0 meters high and the depth of the floor is 4.0 meters, the forward wave speed can be determined as follows: Wave celerity C=√(H+F)), or C=√(9.81×(2+4)), which equals 7.67 meters per second or 25.2 feet per second. Thus, the forward speed of the wave segments will be about 7.67 meters per second, which is nearly 50% faster than the speed of a wave that is 1.0 meter high.

The following results are achieved with a wave height of 2.0 m when using dividing walls with a 20 degree fade angle:

When dividing walls 20, 22 have a 20 degree fade, L2=4+(4×0.3491)=5.396 meters, which shows that the wave segment will elongate by a total of about 1.4 meters or about 4.6 feet (2.3 feet on each side), i.e., from 4.0 meters to 5.4 meters. This means that if the wave segment takes about 0.52 seconds to travel that distance (4.0 meters at 7.67 meters per second), the lateral spread velocity on each side will be about 1.35 meters per second, or about 4.4 feet per second, with a combined lateral spread velocity or convergence speed of close to 2.7 meters per second, or about 8.8 feet per second, which is about one-half the forward speed of the wave in this case (without taking into account the extent to which the wave will slow down). Accordingly, it can be seen that the forces created as the wave segments interfere with each other and collide together may make it difficult to prevent undesired disturbances and turbulences, such as eddies and flow sheers, from forming.

With a starting wave height of 2.0 meters, the following wave height differential is obtained: H1/H2=√(1+((4/4)×0.3491)))=1.1615. This means that if H1 begins at 2.0 meter at L1, H2 will end up about 1.72 meters at L2, which is a drop of about 0.28 meters, or about 10.9 inches.

Nevertheless, because there is a stagger angle that causes the wave segments to merge at two different locations along the downstream path, first on one side, and then on the opposite side, it will now be necessary to determine the arc width and wave height differentials at points L2 and L3, where D2 at L2 is equal to 4.0 meters, and D3 at L3 is estimated to be 9.3 meters. Based on the above, the following results can be obtained:

First, by the time the wave segment reaches the distal end of long dividing wall 72, L3 will be as follows: L3=4+(9.3×0.34591)=7.22 meters. This shows that the wave segment will have elongated by a total of about 3.22 meters or about 10.6 feet, which translates to about 1.33 meters per second, or about 4.4 feet per second, with a combined lateral spread velocity or convergence speed of about 2.67 meters per second or about 8.7 feet per second.

With the starting wave height of 2.0 meters, the following results can be obtained: H1/H3=√(1+((9.3/4)×0.34591)))=1.343, wherein, it can be seen that the wave segment will drop by a ratio of about 1.343, which means that if H1 begins at 2.0 meter at L1, H3 will be about 1.49 meters at L3, which is a drop of about 0.51 meters or about 20.1 inches.

What this shows is that when the wave segments actually merge together, one wave segment will be about 1.72 meters high, and the other wave segment will be about 1.49 meters high, which is a height differential of about 0.23 meters, or 9 inches, which may cause unwanted disturbances and turbulences to occur.

Based on the above, it can be seen that the combination of the lateral spread velocity, which tends to cause the wave segments to collide/interfere at a speed of about 2.54 meters per second, and the wave height differential of about 9 inches, can cause undesired disturbances and turbulences to be formed.

For these reasons, it can be seen that as the wave height and wave speed increase, the lower the fade angle between the dividing walls 70, 72 should be, in order to produce smooth progressive waves.

Figure 11:
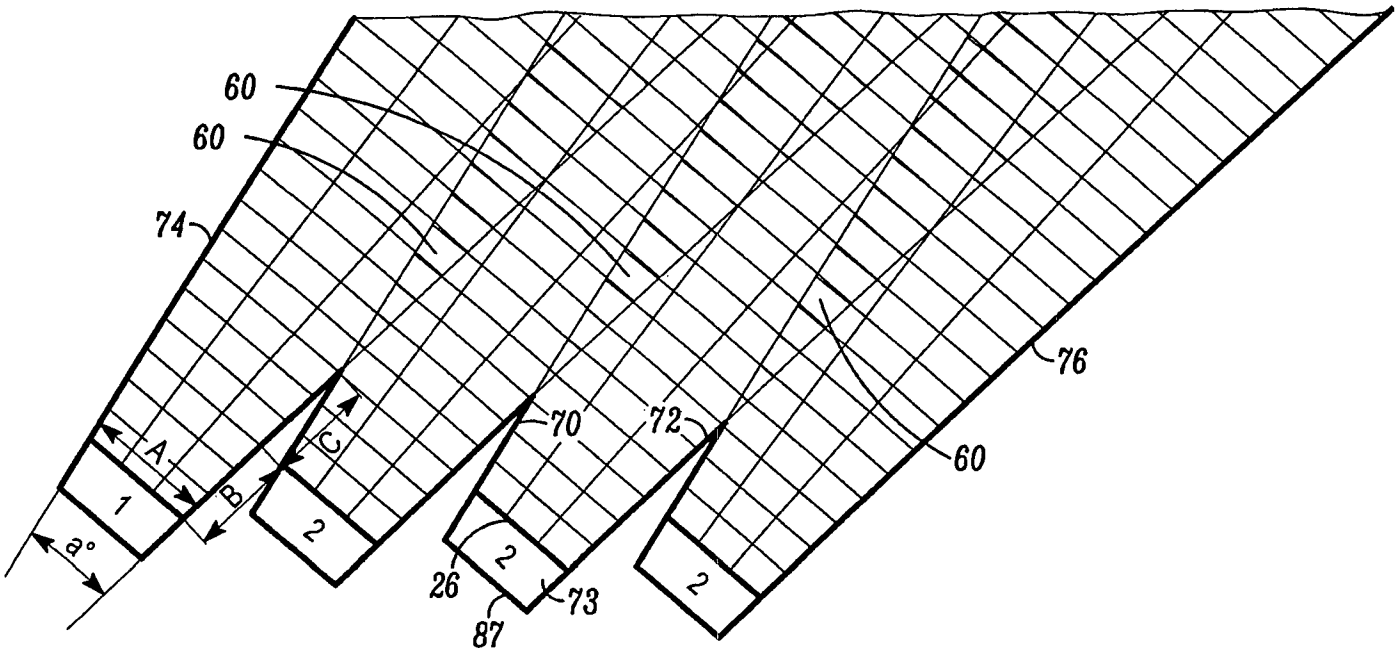
FIG. 11 is a plan view of an embodiment similar to the one shown in FIG. 6, wherein the dividing walls in front of each wave generator are angled to a certain degree relative to each other, i.e., this example shows a fade of about 15 degrees, wherein a grid pattern is shown indicating that the wave segments that are formed begin to widen and spread out as they travel forward, wherein as they converge, the lateral down-line spread velocity of each wave segment causes adjacent wave segments to interfere with each other, wherein the crisscross pattern that extends beyond the dividing walls shows that the wave segments will cross over each other and produce a certain degree of unwanted cross directional formations, turbulence and unwanted disturbances as they travel downstream depending on the amount of the fade angle.
Figure 12:
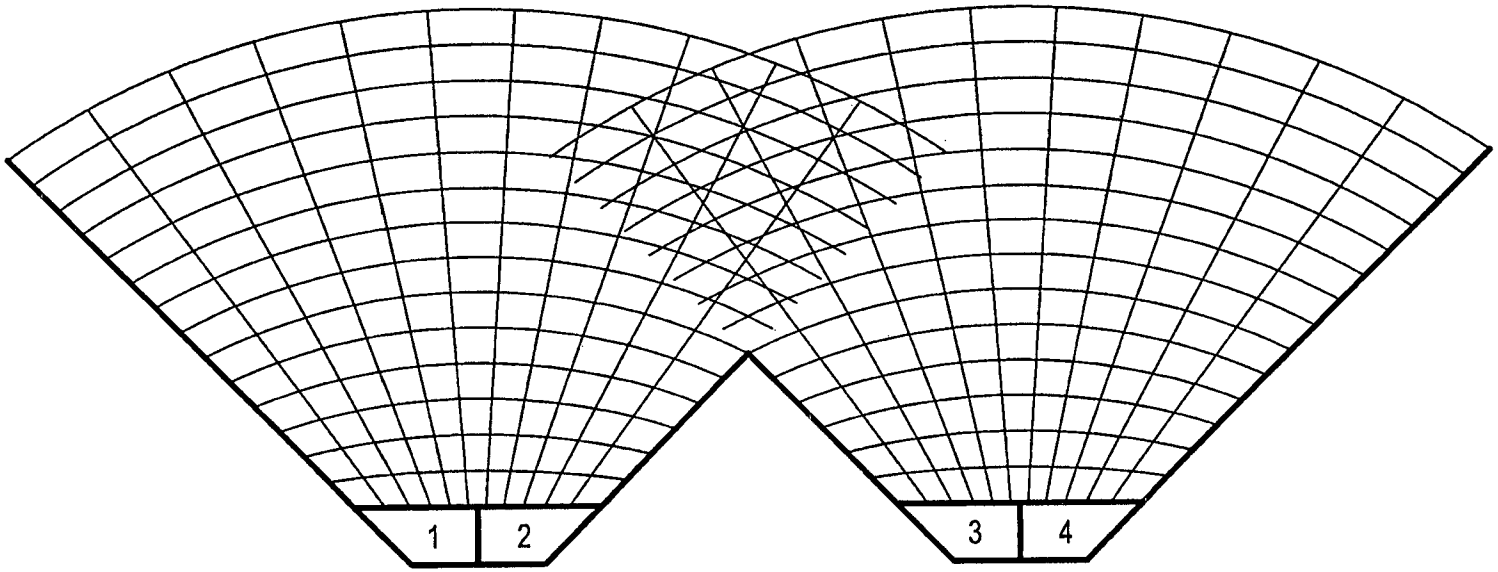
FIG. 12 is a plan view of an embodiment similar to Leigh, wherein the dividing walls in front of each wave generator are angled at about 70 degrees relative to each other, wherein the wave segments are extended radially outward in the shape of an arc and elongate significantly as they travel forward, wherein as they converge, the lateral down-line spread velocity of each wave segment will cause them to significantly interfere with each other and disadvantageously mix, wherein the crisscross pattern extending beyond the dividing walls shows that there will be a significant amount of turbulence and surface disturbance along the convergence zones which are unacceptable for surfing purposes.

7. Comparison of Different Dividing Wall Angles and Wave Heights:

FIGS. 10-12 show examples of wave pools with three different configurations each having a different dividing wall angle, wherein how the wave segments form and transition and converge together and travel forward across the pool are shown and represented by a grid line pattern representing the shape of the waves.

For example, FIG. 10 shows an embodiment similar to FIG. 1 wherein wave generators 3 and caissons 17 are oriented in a staggered manner (numbered 1, 2, 3 and 4), and dividing walls 20, 22 are extended in front of each wave generator 3 substantially parallel to each other. The wave segments are shown by the grid pattern and remain substantially identical in size and shape as they travel forward and merge together to form a resultant wave that travels across the pool from the deep end to the shallow end. As can be seen, a consistent grid pattern is shown wherein the wave segments essentially maintain the same size and shape throughout, including after they merge together along convergence lines 60. Because dividing walls 20, 22 are substantially parallel to each other, and the wave segments are not elongated as they travel downstream, the wave segments can maintain their energy, as well as their height and shape, wherein these represent ideal conditions for producing high quality surfable waves. Because the wave segments are not substantially altered as they travel forward, it can be seen that little turbulence and disturbance occurs along the convergence lines 60, thereby helping to create smooth surfable progressive waves.

FIG. 11 is a similar representation showing an embodiment where the dividing walls 70, 72 are off parallel to a certain degree, i.e., about 15 degrees of fade in this example, which is similar to the embodiment shown in FIG. 6. In this case, because the dividing walls have a slight fade, the wave segments shown by the line pattern begin to elongate or spread out, and continue to elongate as they travel downstream, wherein as they pass beyond the dividing walls, they begin to converge with each other, i.e., the crisscross lines indicate that the wave segments continue to elongate and collide/interfere with one another. The extended lines show that but for the presence of the adjacent wave segments, those segments would have continued to elongate. That is, as the wave segments travel forward, they produce a lateral spread velocity that will cause the wave segments to collide against each other, or otherwise by crisscross and pass by each other, wherein the extent to which the lines crisscross indicates the extent to which the spread velocities will cause the wave segments to overlap.

In this case, it can be seen that the wave segments do not necessarily retain their original size and shape as they travel forward and merge together to form a resultant wave that travels across the pool from the deep end to the shallow end. And, as can be seen, the grid pattern shows that each wave segment will eventually begin to arc as it travels forward, wherein as the wave segments converge, the arcs will begin to converge and interfere with each other at different angles. Thus, the energies released by the two segments converging would have to be absorbed and dissipated for a resultant wave to be produced properly. This indicates there is a likelihood that there will be some undesirable turbulence and disturbance along the convergence zones, although the extent of the disturbance may still be within the allowable limits for surfing.

FIG. 12 is another representation showing an embodiment where the dividing walls 70, 72 are about 70 degrees off parallel relative to each other, which is essentially the case in Leigh. In this case, the wave segments shown by the line pattern begin to elongate significantly and spread out and arc between the dividing walls, and continue to elongate and fan out as they continue to travel downstream, wherein as they pass beyond the dividing walls, and begin to converge with each other, the crisscross lines indicate the extent to which the wave segments cross over each other and dissipate at different angles. As the wave segments travel forward, they produce a lateral spread velocity that will cause the wave segments to interfere with and pass through each other, wherein the extent to which the lines crisscross indicates the extent to which the spread velocities will cause the wave segments to undesirably collide/interfere.

It can also be seen that the wave segments do not retain their original size and shape as they travel forward and instead begin to elongate and fan out and arc significantly such that by the time they converge, they are at a significantly different angle, i.e., as much as 30 degrees or more, and collide/interfere with significant variable force, such that it would be very unlikely that they would form a resultant uniformly shaped progressive wave that could travel uniformly across the wave pool. As can be seen, the grid pattern shows that each wave segment will begin to fan out and elongate, wherein as the wave segments converge, there will be a significant overlap, wherein the overlap shows the extent to which the segments will have difficulty converging and forming a resultant wave.

Because dividing walls 70, 72 are angled to such a large degree, and the wave segments are elongated and fan out significantly as they travel downstream, the wave segments cannot maintain their energy, nor their size, nor shape, before or after they converge, wherein the end result is that whatever formation results would not be uniform, and would instead be filled with substantial unwanted turbulence and disturbances including significant cross-directional and secondary wave formations, eddies and flow sheers, which will cause the wave segments to dissipate considerably and lose a significant portion of their energy. The wave segments will be altered as they travel forward, wherein, it can be seen that the amount of turbulence and disturbance created will be significant, so much so that it would be nearly impossible for a smooth surfable wave to be produced.

Some of the data relative to the specific examples above are shown in FIGS. 13*a*, 13*b* and 13*c*, which show charts based on calculations of various embodiments with dividing walls having different fade angles, i.e., 5, 10, 15, 20 and 30 degrees, and different wave heights, i.e., 1.0 m, 2.0 m, and 3.0 m, wherein the charts show the arc width and wave height differentials, as well as how the convergence speeds of the wave segments differ as the fade angle and wave height changes. In each of these examples, as well as in the data of FIGS. 13*a*, 13*b*, and 13*c*, the embodiments are assumed to have a caisson width of 4.0 meters, and a wall extension (from the caisson front wall to the end of the short dividing wall) of 4.0 meters, i.e., L1=D=4.0 m. Some of the data, however, are approximated.

For example, the wave speed, spread speed and convergence speed are approximated because there are variables that affect these speeds which have not been taken into account. For example, when a wave segment progresses forward, the center of the arc that they form tends to travel faster downstream than the edge of the arc, which is a function of the fade angle, but in this case, the forward speed of the wave segment is assumed to be constant across the width of the wave segment despite the fade angle. There have also been other assumptions made, as discussed above, regarding the distance from the caisson to the distal end of the long dividing wall, which can vary depending on the fade angle and stagger angle, but which, for purposes of these examples, is assumed to be constant, i.e., the assumption is that the distance from the caisson to the distal end of the long dividing wall is 9.3 meters, regardless of the fade angle or stagger angle. While it may be true that this dimension is applicable when the fade angle is about 10 degrees, and the stagger angle is about 45 degrees, it may not be applicable in other cases such as when the fade angle or stagger angle is varied.

Nevertheless, from a comparison standpoint, the charts should provide a fairly accurate representation of the various factors that should be taken into account when designing a wave pool of this kind. That is, while the numbers may not be exactly as indicated, they do tend to show the following general principles: 1) When the fade angle is increased, the arc width and wave height differentials at the point of convergence increase, 2) When the fade angle is increased, the convergence speed—the speed at which the adjacent wave segments converge—increases, 3) When the wave height is increased, the wave height differential at the point of convergence increases, and 4) When the wave height is increased, the convergence speed—the speed at which adjacent wave segments converge—increases. Accordingly, what these charts show is that changing the fade angle and/or wave height can have a significant effect on the quality of the convergence, and therefore, the extent of the change in fade will have to be based on the desired wave height and wave quality, etc.

For example, according to FIG. 13*a*, which shows an embodiment where the wave height starts at 1.0 meter high, the arc width of the wave segment (which begins at 4.0 m) increases as the wave segment progresses forward and spreads out due to the fade angle. For instance, when the fade angle is 10 degrees, the lateral arc width of the wave segment will increase over time, such that by the time it reaches the first convergence point, i.e., the distal end of the short dividing wall, it will be 4.69 m, and then, as the wave segment travels further, by the time it reaches the second convergence point, i.e., the distal end of the long dividing wall, it will increase to 5.62 m. Moreover, when the fade angle is 20 degrees, the arc width of the wave segment starts out at 4.0 m, and increases to 5.4 m, and then, to 7.22 m, during the same spans. And, when the fade angle is 30 degrees, the arc width of the wave segment increases from 4.0 m to 6.1 m, and then, to 8.87 m, during the same spans, i.e., by the time the wave segments converge on both sides.

The chart also indicates that as the wave segments spread out, they decrease in height, which is also a function of the fade angle. For example, when the fade angle is 10 degrees, and the wave segments start out with a wave height of 1.0 m, by the time they travel to the first convergence point, which is a distance of 4.0 m downstream, the wave height of the segment will decrease from 1.0 m to 0.92 m, which is a drop of 0.08 m, and then, as they travel forward, by the time the wave segments converge on both sides, the wave segment will decrease to 0.84 m, while the adjacent wave segment will still be at 0.92 m (because of the stagger angle), wherein one wave segment will be 0.08 m higher than the other at the point of convergence, which represents the wave height differential. Likewise, when the fade angle is 20 degrees, the wave segment will decrease in height from 1.0 m to 0.86 m, and then, from 0.86 to 0.74 m, during the same spans, wherein one wave segment will be 0.12 m higher than the other wave segment at the time of convergence. And, when the fade angle is 30 degrees, the wave segment will decrease in height from 1.0 m to 0.81 m, and then, from 0.81 to 0.67 m, during the same spans, wherein one wave segment will be 0.14 m higher than the other at the time of convergence, which represents the wave height differential.

FIG. 13*a* also shows that the speed at which the adjacent wave segments converge with each other along the convergence zone also increases as the fade angle increases, wherein when the fade angle is 10 degrees, the convergence speed is 0.92 meters per second, whereas, when the fade is 20 degrees, the convergence speed is 1.80 meters per second, and when the fade is 30 degrees, the convergence speed is 2.80 meters per second, which is about a three-fold increase.

FIG. 13*b* shows similar details regarding an embodiment where the wave height starts out at 2.0 meters high, and in this case, while the arc width differential remains the same as before, as the fade angle changes, the wave height differential and convergence speed changes.

For example, when the fade angle is 10 degrees, although the wave segments start at 2.0 m high, by the time they travel a distance of 4.0 m downstream, their height will decrease to 1.85 m, which is a drop of 0.15 m, and then, as they travel further, by the time the wave segments converge on both sides, the wave segment will decrease in height to 1.69 m, such that one wave segment will be 0.16 m higher than the other at the time of convergence, which represents the wave height differential. It also indicates that with a fade angle of 20 degrees, the wave segments will decrease in height from 2.0 m to 1.72 m, and then, to 1.49 m, such that by the time the wave segments converge on both sides, one will be 0.23 m higher than the other. Then, when the fade angle is 30 degrees, the wave segments will decrease in height from 2.0 m to 1.62 m, and then to 1.34 m, such that by the time both sides converge, one wave segment will be 0.28 m higher than the other.

According to FIG. 13*b*, the speed at which the adjacent wave segments converge with each other along the convergence zone increases as the fade angle increases, wherein when the fade angle is 10 degrees, the convergence speed is 1.35 meters per second, whereas, when the fade is 30 degrees, the convergence speed Is 4.04 meters per second, which is about a three-fold increase. A comparison between FIGS. 13*a* and 13*b* also shows that the convergence speed increases when the wave height increases, wherein, when the fade angle is 10 degrees, and the wave height is 1.0 m, the convergence speed is 0.92 meters per second, whereas, when the fade angle is the same, i.e., 10 degrees, and the wave height is 2.0 m, the convergence speed is 1.35 meters per second. Likewise, when the fade angle is 20 degrees, and the wave height is 1.0 m, the convergence speed is 1.80 meters per second, whereas, when the fade angle is the same, i.e., 20 degrees, and the wave height is 2.0 m, the convergence speed is 2.67 meters per second. The same sorts of differences are found when the fade angle is 30 degrees.

Finally, FIG. 13*c* shows an embodiment where the wave height starts out at 3.0 meters high, and in this case, when the fade angle is 10 degrees, by the time the wave segments travel a distance of 4.0 m downstream, their height will decrease to 2.77 m, which is a drop of 0.23 m, and then, as they travel further, by the time the wave segments converge on both sides, the wave segment will decrease in height to 2.53 m, such that one wave segment will be 0.24 m higher than the other at the time of convergence. It also indicates that with a fade angle of 20 degrees, the wave segments will decrease in height from 3.0 m to 2.58 m, and then, to 2.23 m, such that by the time the wave segments converge on both sides, one will be 0.35 m higher than the other. And, when the fade angle is 30 degrees, the wave segments will decrease in height from 3.0 m to 2.43 m, and then to 2.01 m, such that by the time both sides converge, one wave segment will be 0.42 m higher than the other.

The speed at which the adjacent wave segments converge with each other along the convergence zone also increases as the fade angle increases, wherein when the fade angle is 10 degrees, the convergence speed is 1.64 meters per second, whereas, when the fade is 30 degrees, the convergence speed is 4.94 meters per second, which is about a three-fold increase. In this respect, it can be seen that the convergence speed (with a wave height of 3.0 m) is almost as high as the forward celerity of the wave segment when the wave height is 1.0 m, as shown in FIG. 13*a*, i.e., one is 4.49 meters per second whereas the other is 5.42 meters per second.

Moreover, a comparison between FIGS. 13*a*, 13*b* and 13*c* shows that the convergence speed increases when the wave height increases. For example, when the fade angle is 10 degrees, and the wave height is 1.0 m, the convergence speed is 0.92 meters per second, whereas, when the fade angle is the same, i.e., 10 degrees, and the wave height is 3.0 m, the convergence speed is 1.64 meters per second. Likewise, when the fade angle is 20 degrees, and the wave height is 1.0 m, the convergence speed is 1.80 meters per second, whereas, when the fade angle is the same, i.e., 20 degrees, and the wave height is 3.0 m, the convergence speed is 3.29 meters per second.

What these examples clearly show is that as the fade angle is increased, there are additional forces that begin to occur along the convergence zones that will make it more difficult to create high quality surfable waves. The same is true when the wave height is increased. That is, as one or more of these factors is/are increased, the wave height differential and the convergence speed are also increased, which can negatively affect the quality of the resultant waves. Accordingly, when higher fade angles are contemplated, the wave height should be reduced to produce the same quality waves, and likewise, when higher wave heights are contemplated, the fade angle should be decreased to produce the same quality waves.

Based on the data in the charts, one potential factor that could be used to determine whether a particular wave is suitable for surfing is to consider the wave height differential and the degree to which it could create ripples and chops on the wave surface that could potentially make surfing more difficult. Although this is not an exact figure, the wave height differential has to do with the relative heights of the adjacent wave segments at the time the wave segments converge, such that, the actual disturbance or turbulence, whether a ripple or chop, may then be considered a function of the wave height differential. And, the greater the wave height differential, the greater will be the disturbance or turbulence created in the resultant wave. That is, the greater the wave height differential, the greater the likelihood that a greater disturbance will be created, wherein this factor can be used as a quantitative indicator to show whether, given a certain wave height differential, a high quality surfable wave can be produced.

Moreover, the degree to which a disturbance is created on the wave surface may also be quantitatively measured relative to the convergence speed of the merging wave segments, which is the net speed at which the two adjacent wave segments converge laterally with each other, wherein the higher the relative velocities, the more energy or impact the wave segments will generate, wherein a greater force will likely result in the creation of more eddies, swirls and flow sheers on the wave surface. That is, when two adjacent wave segments spread out laterally, and eventually merge, the tendency is for them to collide and interfere with each other, i.e., crisscross at the point of convergence, wherein there will likely be a greater force generated when the relative speeds are greater, wherein greater turbulence and disturbance will likely occur, which can be detrimental to the formation of high quality surfable waves.

Indeed, the combination of the greater wave height differential and the greater convergence speed can lead to the deterioration of the resultant waves as the wave segments converge. That is, when the wave height differential and the convergence speed are increased, there will be a greater likelihood that they will produce greater turbulence and disturbance on the wave surface, such that by increasing one or the other or both, the likelihood of creating a high quality surfable wave will be reduced. In this respect, it can be seen that there will be a tendency for not only the two water masses to collide against each other with greater force, but also, when there is a wave height differential, excess water from the top of one wave segment can spill over onto the top of the lower wave segment, wherein the greater the wave height differential, the greater will be the disturbance and turbulence created on the wave surface.

Some examples of how the above data can be used to determine the acceptable fade angle are presented as follows: First, one way to determine whether a fade angle is acceptable might be to specify a maximum wave height differential, such as 12 cm. And, because this amount relates to the size of a standard surfboard, and how it is curved, it could also relate to the ability of a surfer to maneuver the board on the wave surface without causing the tip of the board to catch a ripple or chop, which could cause the board to be diverted, or the nose to dive into the wave. Although there may not be a direct correlation between the wave height differential and the size of the ripple or chop that it creates, it can be seen that the greater the wave height differential, the greater will be the disturbance or turbulence, and therefore, the greater will be the ripple or chop created on the wave surface.

Based on the above, one method of helping to ensure a high quality wave might be to ensure that the wave height differential is no greater than about 12 cm. And, in this respect, to meet this requirement, according to FIG. 13*a*, when the wave height starts at 1.0 m, the fade angle should be no more than about 20 degrees, and when the wave height starts at 2.0 m, the fade angle should be no more than about 7 degrees, and when the wave height starts at 3.0 m, the fade angle should be no more than about 4 degrees. These limitations could also be set at 15 cm or other wave height differential that might be appropriate depending on the desired quality of the waves.

Second, another possible way to determine the maximum acceptable fade angle might be to specify that the fade angle must produce no more than a predetermined convergence speed, such as 1.80 meters per second. In such case, to avoid a convergence speed exceeding 1.80 meters per second, it can be seen that with a 1.0 m wave height, the fade angle should be no more than about 20 degrees, and with a 2.0 m wave height, the fade angle should be no more than about 13 degrees, and with a 3.0 m wave height, the fade angle should be no more than about 11 degrees. These limitations could also be set at 1.50 meters per second or 2.0 meters per second or other figure depending on the desired quality of the waves.

Third, another way to determine the maximum acceptable fade angle is to specify a combination of the above two requirements, i.e., for example, one limitation may require that the wave height differential be no more than 15 cm, and that the convergence speed be no more than 1.50 meters per second. In such case, it can be seen that with a 1.0 m wave height, the maximum fade angle might be no more than about 16 degrees, and with a 2.0 m wave height, the maximum fade angle might be no more than about 9 degrees, and with a 3.0 m wave height, the maximum fade angle might be no more than about 5 degrees. Of course, these requirements can also be modified depending on the nature and quality of the desired waves. And, because the wave height affects the allowable fade angle, the highest wave height contemplated for a particular wave pool should be used to determine the allowable fade angle. These quantitative measurements can be used to analyze and determine what the acceptable fade angle might be for virtually any type of wave pool configuration and/or wave height and/or quality of the waves.

FIG. 14 is a plan view of another embodiment of wave pool 100 having a plurality of wave generators 3 extended along a relatively deep end 105, along an obliquely oriented stagger line 106, and a sloped shoreline 7 extended along an opposite shallow end 11, along a break line 9. In this embodiment, a series of wave generators 3 (extended along stagger line 106) and sloped shoreline 7 (extended along break line 9) are not parallel to each other, wherein peel angle 114 and stagger angle 115 are extended at different angles relative to the lateral down-line direction of the front or crest of waves 103 (which travel in the direction designated by arrow 10). Side walls 2, 4 are preferably extended substantially parallel to each other although not necessarily so.

Like the other embodiments, multiple wave generators 3 are preferably oriented at an oblique angle 115 relative to the front or crest of waves 13, and in a staggered or offset manner relative to the wave direction 10, as shown in FIG. 14. The angle 115 at which stagger line 106 extends relative to the front or crest or wave 103 is the "stagger angle" and the angle 114 at which break line 9 extends relative to front or crest of waves 103 is the "peel angle," wherein, in this embodiment, those angles differ. Because the stagger angle 115 in this embodiment is lower than in the preferred embodiment, it can be seen that the wave generators 3 would have to be activated in sequence with less time elapsing between each one. This is because it will take less time for each wave segment emanating from each wave generator 3 to reach the front wall of the next succeeding wave generator 3, which is necessary for the wave segments to merge to create waves 103 that travel in direction 10. This embodiment also has caissons 17 that are staggered, wherein each adjacent caisson 17 has a pair of dividing walls 20, 22, extending substantially forward in the wave direction 10, wherein dividing walls 20, 22 are extended substantially parallel to each other in the preferred embodiment, and in other embodiments, with no more than about a 10 to 20 degree fade ("off parallel") between them, as discussed.

FIG. 15 is a plan view of yet another embodiment of wave pool 110 having a plurality of wave generators 3 extended along a relatively deep end 105, which is extended along a variable stagger line 116, 118, 120. This embodiment also has a sloped shoreline 7 extended along an opposite shallow end 11, along break line 9, but in this embodiment, the series of wave generators 3 and caissons 17 are staggered and extended along stagger line 116, 118, 120, which has three different stagger angles, including a 45 degree angle 116, a 30 degree angle 118, and a 0 degree angle 120.

Like the other embodiments, multiple wave generators 3 are preferably positioned within multiple caissons 17 which are oriented along stagger line 116, 118, and 120, relative to the front or crest of waves 13. Caissons 17 are mostly oriented in a staggered manner relative to wave direction 10, as shown in FIG. 15, except that in this embodiment, caissons 17 extended along stagger line 120 are not staggered at all. Because the stagger angles 116, 118 and 120 in this embodiment differ from one location to the other, it can be seen that the time that elapses between the activation of adjacent wave generators 3 in sequence would have to be varied in order for the wave segments to merge properly, to create waves 123 that travel in direction 10. That is, the time that elapses between each wave generator 3 being activated in sequence would have to be constant through stagger line 116, and then, it would have to be shorter through stagger line 118, and then, along stagger line 120, all the wave generators 3 would have to be activated at the same time, to create progressive wave 123 that moves in direction 10. This embodiment also has caissons 17 with a pair of dividing walls 20, 22, extending substantially forward in the front of each wave generator, wherein dividing walls 20, 22 are preferably extended substantially parallel to each other, and in other embodiments, they can have no more than about a 10 to 20 degree fade ("off parallel") between them, as discussed.

What is claimed is:

1. A wave pool comprising:

a plurality of wave generators adapted to produce wave segments that travel forward in said wave pool, wherein said wave generators are extended in a substantially staggered manner relative to the travel direction of the wave segments;

wherein each of said plurality of wave generators has a pair of dividing walls extended in a substantially forward direction, wherein within each pair, each dividing wall is extended forward beyond a front of the associated wave generator, and wherein within each pair, said dividing walls are extended substantially parallel to each other or with a fade angle of no more than 20 degrees relative to each other, so that they substantially limit the longitudinal expansion of the wave segment that travels forward between them, wherein the dividing walls help to enable the associated wave segments to form and merge together to form a single resultant wave suitable for surfing; and a sloped floor extended within said wave pool, wherein said floor comprises an incline that enables the resultant wave to break thereon.

2. The wave pool of claim 1, wherein said wave generators are adapted to be operated in sequence from one side of said wave pool to the other, such that by operating said wave generators in this manner, a plurality of wave segments is generated at pre-selected time intervals, such that as the wave segments travel forward, they merge together to form a substantially uniform resultant wave.

3. The wave pool of claim 2, wherein within each pair of dividing walls, one of said dividing walls extends further forward than the other of said dividing walls, such that there is a short dividing wall and a long dividing wall, and said wave pool is adapted such that as each wave segment travels forward through an associated pair of dividing walls, said wave segment first merges on one side with a first adjacent wave segment generated by a preceding wave generator in the sequence, and then on the opposite side with a second adjacent wave segment generated by a succeeding wave generator in the sequence.

4. The wave pool of claim 3, wherein each wave generator has a front wall, and the associated pair of dividing walls in front of each wave generator extends forward beyond said front wall, and wherein, between adjacent wave generators in the sequence, the short dividing wall of one wave generator forms part of the long dividing wall of an adjacent wave generator in the sequence.

5. The wave pool of claim 3, wherein in front of each wave generator is formed a wave formation zone, a partial wave convergence zone and a full wave convergence zone, wherein in front of each of said wave generators, 1) said wave formation zone extends forward from a front wall to a distal end of said short dividing wall, 2) said partial wave convergence zone extends forward from a distal end of said short dividing wall to a distal end of said long dividing wall, and 3) said full wave convergence zone extends forward from a distal end of said long dividing wall in a direction toward said incline.

6. The wave pool of claim 1, wherein each of said wave generators comprises a caisson and is adapted to generate wave movements within said wave pool, wherein said wave generators are taken from the group consisting of the following:

a) pneumatically operated wave generator;

b) oscillatory pneumatic wave generator;

c) surge wave generator;

d) oscillatory mechanical wave generator.

7. The wave pool of claim 1, wherein said wave generators are extended along a stagger angle and said incline forms a peel angle, wherein 1) said stagger angle and said peel angle are substantially the same and extended at an angle of about 30 to 70 degrees relative to the down-line front or crest of the resultant wave, 2) said stagger angle and said peel angle are not the same but are extended at an angle of about 30 to 70 degrees relative to the down-line front or crest of the resultant wave, or 3) said peel angle is extended at an angle of about 30 to 70 degrees relative to the down-line front or crest of the resultant wave and said stagger angle varies.

8. The wave pool of claim 1, wherein said wave pool comprises a wave dampening system having a perforated floor for dampening the resultant wave as it breaks along said incline.

9. The wave pool of claim 1, wherein the distal end of each of said dividing walls extending between adjacent wave generators is tapered or narrowed.

10. A wave pool comprising:

a plurality of wave generators adapted to produce wave segments that travel forward in said wave pool, wherein said wave generators are extended in a substantially staggered manner relative to the travel direction of the wave segments;

wherein each wave generator has a pair of dividing walls extended in a substantially forward direction, wherein each dividing wall extends forward beyond a front of the associated wave generator, wherein within each of said pair of dividing walls, one associated dividing wall is extended further forward than the other associated dividing wall, such that there is a short dividing wall and a long dividing wall, and wherein within each pair, said dividing walls are extended substantially parallel to each other or with a fade angle of no more than 20 degrees relative to each other;

wherein in front of each wave generator is formed a wave formation zone, a partial wave convergence zone and a full wave convergence zone, such that said dividing walls enable the wave segments to form and merge together to form a single resultant wave suitable for surfing; and a sloped floor extended substantially in said wave pool, wherein said floor comprises an incline that enables the resultant wave to break thereon.

11. The wave pool of claim 10, wherein said wave generators are adapted to be operated in sequence from one side of said wave pool to the other, such that by operating said wave generators in this manner, a plurality of wave segments is generated at pre-selected time intervals, such that as the wave segments travel forward, due to the stagger of said wave generators, they merge together to form a substantially uniform resultant wave.

12. The wave pool of claim 11, wherein each wave generator has a front wall, and the associated pair of dividing walls extending in front of each wave generator extends forward beyond said front wall, and wherein, between adjacent wave generators in the sequence, the short dividing wall of one wave generator forms part of the long dividing wall of an adjacent wave generator in the sequence.

13. The wave pool of claim 11, wherein the wave pool is adapted such that as each wave segment travels forward, and passes beyond said associated pair of dividing walls, each wave segment first merges with a first adjacent wave segment generated by a preceding wave generator in the sequence after passing beyond the short dividing wall, and then afterwards it merges with a second adjacent wave segment generated by a succeeding wave generator in the sequence after passing beyond the long dividing wall.

14. The wave pool of claim 10, wherein each of said wave generators comprises a caisson and is adapted to generate wave movements within said wave pool and said wave generators are taken from the group consisting of the following:

a) pneumatically operated wave generator;

b) oscillatory pneumatic wave generator;

c) surge wave generator;

d) oscillatory mechanical wave generator.

15. The wave pool of claim 10, wherein said wave generators are extended along a stagger angle and said incline forms a peel angle, wherein 1) said stagger angle and said peel angle are substantially the same and extended at an angle of about 30 to 70 degrees relative to the down-line front or crest of the resultant wave, 2) said stagger angle and said peel angle are not the same but are extended at an angle of about 30 to 70 degrees relative to the down-line front or crest of the resultant wave, or 3) said peel angle is extended at an angle of about 30 to 70 degrees relative to the down-line front or crest of the resultant wave and said stagger angle varies.

16. The wave pool of claim 10, wherein said wave pool comprises a wave dampening system having a perforated floor for dampening the resultant wave as it breaks along said incline.

17. The wave pool of claim 10, wherein in front of each of said wave generators, 1) said wave formation zone extends forward from a front wall to a distal end of said short dividing wall, 2) said partial wave convergence zone extends forward from a distal end of said short dividing wall to a distal end of said long dividing wall, and 3) said full wave convergence zone extends forward from a distal end of said long dividing wall in a direction toward said incline.

18. A method of producing waves in a wave pool comprising:

providing a plurality of wave generators for producing wave segments wherein said wave generators are extended in a substantially staggered manner relative to the travel direction of the wave segments;

providing a pair of dividing walls in front of each of said wave generators, wherein each dividing wall extends forward beyond a front wall of the associated wave generator, and wherein within each pair, said dividing walls are extended substantially parallel to each other or with a fade angle of no more than 20 degrees relative to each other, so that they substantially limit the longitudinal expansion of the associated wave segment that travels forward between them;

operating said wave generators in sequence from one side of said wave pool to the other, such that by operating said wave generators in this manner, a plurality of wave segments is generated at pre-selected time intervals;

causing each wave segment produced by each wave generator to travel forward in said travel direction wherein said wave segment travels forward between an associated pair of dividing walls;

allowing said wave segments to pass beyond said associated dividing walls, thereby enabling said wave segments to merge together with adjacent wave segments produced by adjacent wave generators in the sequence, wherein they merge together to form a single resultant wave suitable for surfing; and allowing the resultant wave to form and travel forward and break or dissipate along an inclined floor.

19. The method of claim 18, wherein said pair of dividing walls in front of each of said wave generators forms three zones comprising a wave formation zone, a partial wave convergence zone and a full wave convergence zone, wherein the method comprises the following steps:

forming a first wave segment with a first wave generator and causing said first wave segment to travel forward between a first pair of dividing walls within a first wave formation zone;

forming a second wave segment with a second wave generator and causing said second wave segment to travel forward between a second pair of dividing walls within a second wave formation zone, wherein said second pair of dividing walls comprises a short dividing wall and a long dividing wall, and then causing said second wave segment to merge with said first wave segment after the second wave segment passes beyond said short dividing wall within a partial wave convergence zone; and forming a third wave segment with a third wave generator and causing said third wave segment to travel forward between a third pair of dividing walls within a third wave formation zone, and then causing said third wave segment to merge with said second wave segment as the second wave segment passes beyond said long dividing wall within a full wave convergence zone.

20. The method of claim 18, wherein the method comprises the additional step of allowing the resultant wave to break along said inclined floor, and then dampening the resultant wave using a dampening system comprising a perforated floor.

21. The method of claim 18, wherein within each pair of dividing walls, one associated dividing wall extends further forward than the other associated dividing wall, such that there is a short dividing wall and a long dividing wall, and wherein the method comprises the step of causing each wave segment that travels forward between a pair of dividing walls to first merge with a first adjacent wave segment generated by a preceding wave generator in the sequence after passing beyond the short dividing wall, and then to merge with a second adjacent wave segment generated by a succeeding wave generator in the sequence after passing beyond the long dividing wall.

* * * * *